US007059604B1

(12) United States Patent
Richards et al.

(10) Patent No.: US 7,059,604 B1
(45) **Date of Patent: *Jun. 13, 2006**

(54) METHOD OF CONDUCTING A MULTIPLE HAND CARD GAME

(75) Inventors: David J. Richards, Las Vegas, NV (US); Kimberly Gale Young, Henderson, NV (US); Spencer Caroll Peterson, Henderson, NV (US)

(73) Assignee: Omni Design Group, Inc., Las Vegas, NV (US)

( * ) Notice: Subject to any disclaimer, the term of this patent is extended or adjusted under 35 U.S.C. 154(b) by 37 days.

This patent is subject to a terminal disclaimer.

(21) Appl. No.: 10/838,826

(22) Filed: May 4, 2004

(51) Int. Cl.
*A63F 1/00* (2006.01)

(52) U.S. Cl. ..... 273/292; 463/13; 463/20

(58) Field of Classification Search ..... 273/292; 463/13, 20

See application file for complete search history.

(56) References Cited

U.S. PATENT DOCUMENTS 5,531,440 A * 7/1996 Dabrowski et al. ..... 463/12
5,531,441 A * 7/1996 Dabrowski et al. ..... 463/12
5,544,892 A 8/1996 Breeding
5,823,873 A * 10/1998 Moody ..... 463/13
6,007,066 A * 12/1999 Moody ..... 273/292
6,019,374 A 2/2000 Breeding
6,048,267 A 4/2000 Wichinsky
6,098,985 A * 8/2000 Moody ..... 273/292
6,129,357 A 10/2000 Wichinsky
6,132,311 A 10/2000 Williams
6,334,614 B1 1/2002 Breeding
6,419,578 B1 * 7/2002 Moody et al. ..... 463/13
6,435,509 B1 * 8/2002 Wichinsky et al. ..... 273/292
6,454,266 B1 9/2002 Breeding et al.
6,517,074 B1 * 2/2003 Moody et al. ..... 273/292
6,595,520 B1 * 7/2003 Richards et al. ..... 273/292
6,612,926 B1 * 9/2003 Dabrowski ..... 463/13
6,652,377 B1 * 11/2003 Moody ..... 463/13
6,672,959 B1 * 1/2004 Moody et al. ..... 463/13
6,708,975 B1 * 3/2004 Fox et al. ..... 273/292
6,780,104 B1 * 8/2004 Fox ..... 463/13
6,802,773 B1 * 10/2004 Moody ..... 463/13
6,857,957 B1 * 2/2005 Marks et al. ..... 463/13
6,878,060 B1 * 4/2005 Moody ..... 463/13
2002/0027322 A1 3/2002 Breeding et al.
2002/0063387 A1 5/2002 Breeding et al.

* cited by examiner

*Primary Examiner*—Stephen Blau
*Assistant Examiner*—Dolores R. Collins
(74) *Attorney, Agent, or Firm*—Robert Ryan Morishita; Morishita Law Firm, LLC

(57) ABSTRACT

A card game begins with designating at least one playing card to be a substitute card and defining a substitution pattern for the substitute cards. The first player is dealt a first player hand of cards and at least one additional player hand of cards. The player plays the first player hand to completion. For each additional hand, the substitute cards are copied into other player hands to replace a card in that hand, according to the substitution pattern, only if the substitution results in a higher poker ranking for the hand. Players are rewarded based on the final poker ranking of each player hand after substitution, if any.

16 Claims, 24 Drawing Sheets

METHOD OF CONDUCTING A MULTIPLE HAND CARD GAME

FIELD OF THE INVENTION

The present invention relates to casino video games. More specifically, the present invention is a multiple hand video poker game that includes the possibility of a chance improvement of a hand by cards from another hand.

BACKGROUND OF THE INVENTION

Video draw poker is well known. In the conventional game of video draw poker known in the art, a gaming device is provided wherein the player makes a wager and the device's processor selects from a data structure containing data representing cards in a deck of playing cards, five cards to be displayed face up to represent an initial hand. The player selects which, if any, of the five cards of the initial hand to hold and prompts the processor to discard the remaining cards. The discarded cards are replaced with replacements selected from the data structure to produce a final hand outcome of a five card poker hand. The video draw poker device compares the final outcome to the predetermined winning combinations also stored in a data structure, these combinations frequently representing ranked poker hands. If the player's final outcome matches a winning combination, the player is rewarded. Otherwise, the final outcome is deemed to be a loss and the player's wager is retained.

In a variation of video draw poker, multiple hands may be provided. As with conventional video draw poker, the device's processor randomly deals five cards to a player for an initial hand. The player selects which, if any, of the five cards of the initial hand to hold. Prior to drawing replacement cards for the initial hand, the held cards are copied into the other hands. The player prompts the processor to discard the remaining cards and additional cards are drawn to replace the discarded cards. The processor then repeats the draw step for the additional hands. Thus, a player receives multiple opportunities to draw to the same held cards.

SUMMARY OF THE INVENTION

The method of the present invention is a game utilizing playing cards. At least one playing card is designated a substitute card; optionally a set of cards may be designated substitute cards. Also, a substitution pattern is defined for the substitute cards.

In the wagering form of the game, a player makes a wager for each player hand of cards to be dealt. After the wagers are placed, a first player hand of playing cards is dealt. At least one additional player hand of cards is dealt. The number of cards in each player hand may vary, and it is contemplated that the number of cards in each player hand need not necessarily be the same. The first player hand is played to completion.

For example, in an optional embodiment based on Draw Poker, five cards are dealt and the player selects zero or more cards to be held. Cards not held are discarded and the first player hand is completed by dealing additional cards to replace the discarded cards.

If any of the additional player hands contain one or more cards designated as substitute cards, the substitute cards will replace one or more cards in another player hand according to the predefined substitution pattern, without regard to whether the substitution improves the poker ranking of the hand receiving the substitute card. In other words, the substitute card will replace any card of another hand, according to the predefined substitution pattern. Optionally, the substitution takes place without regard to whether the poker rank of the receiving hand is decreased, increased, or unaffected. In another optional embodiment, the substitution takes place if the poker rank of the receiving hand is increased or unaffected. This process will be repeated for each of the hands.

It is contemplated that the substitution pattern could take any form. For example, in one optional embodiment, the cards of the player hands are arranged into arrays and any substitute card may only replace a card in a corresponding array position in another player hand. In a another optional embodiment, the player hands themselves are arranged serially with each player hand adjacent at least one other player hand. In such an embodiment, substitute cards may replace cards in an adjacent hand.

After substitution, if any, the player is rewarded based on the final poker hands. For example, in one optional embodiment, a fixed paytable is utilized such that players are rewarded based on the final poker ranking of each individual player hand.

DESCRIPTION

Figure 1:
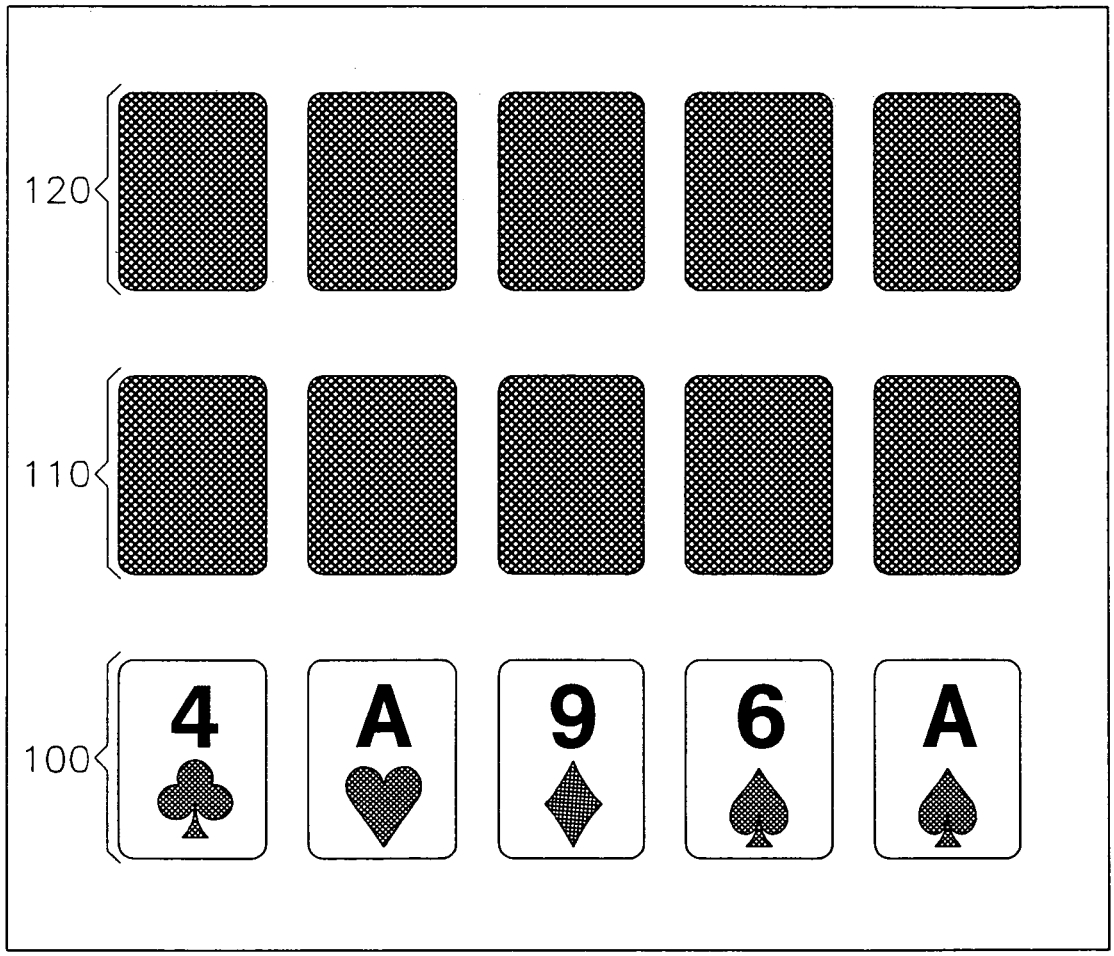
FIG. 1 shows a screen display according to an embodiment of the present invention after an initial deal of the cards.

Reference is now made to the figures wherein like parts are referred to by like numerals throughout. The present invention is a method for playing a multiple player hand poker game. The present method could be conducted in a live setting or in an electronic form, such as via the Internet, via an intranet or other computer network, or on an electronic video machine.

The present method is played using playing cards, such as one or more conventional playing card decks. Referring to FIG. 12, the present invention begins by designating 26 at least one playing card to be a substitute card. In an optional embodiment, multiple substitute cards may be designated 26. Substitute cards may be fixed or may be randomly selected prior to the start of each game. It is also contemplated that, in one optional embodiment, a player may choose to designate one or more specific cards as substitute cards prior to the start of a game. While any playing card, including Jokers, designated wild cards, supplemental cards, or the like could be designated substitute cards, in the optional embodiment of FIGS. 1–11, Aces have been designated as substitute cards.

A substitution pattern is also defined 32 for the substitute card or cards. The purpose of the substitution pattern is described in greater detail below. Generally speaking, the substitution pattern is the set of rules for the way the substitute cards replace cards in other player hands.

In a wagering format of the game, a player places 20 a wager. In one optional, the wager placed 20 by the player determines the number of hands that will be played. In such an embodiment, a player wagers by designating the number of hands to be played and a quantity to be wagered on each hand. It is also contemplated, however, that a player may make a wager and an the wager will be automatically allocated among active hands.

An first player hand of cards is dealt 22 to the player. It is contemplated that any number of cards may be dealt as an first player hand, however, in an optional embodiment shown in FIGS. 1–11, five cards are dealt.

Referring again to FIG. 12, the player plays 24 the first player hand to completion. By stating that the first player hand is played 24 to completion, it is contemplated that the first player hand may be played according to the rules of draw poker, stud poker, or any other card game method. For example, if the first player hand is played according to stud poker rules, no action on the part of the player is required to play 24 a hand to completion. In the optional embodiment of FIGS. 1–11, played according to draw poker rules, completing the first player hand involves the steps of selecting zero or more cards to hold and discarding those cards. The first player hand is completed by dealing additional cards to replace discarded cards. The poker rank of the completed first player hand is determined.

With continued reference to FIG. 12, at least one additional player hand is dealt 22. The additional player hands could be dealt 22 at any time during play including before, after, or during play of the first player hand. In one optional embodiment, the additional player hands are dealt 22 after completion of the first player hand. In another optional embodiment, the additional player hands are dealt 22 with the first player hand. In such an embodiment, the additional player hands may be exposed at any point during play of the first hand. For example, the additional player hands may be dealt face up or dealt face down and exposed during or after play of the first player hand. Again, any number of cards may be dealt to each additional player hand, however, in the optional embodiment of FIGS. 1–11, five cards are dealt to form each additional player hand. While the embodiment shown in FIGS. 1–11 shows each player hand dealt from a separate, complete deck, it is contemplated that the additional player hands could be dealt from a deck depleted of the cards of the first player hand in an alternate optional embodiment. The additional player hands could be operated in any manner, in an optional embodiment, the additional player hands are stud poker hands. That is, in such an optional embodiment, the player cannot select cards to hold from the player hand and draw replacements. However, as described below, substitutions from other player hands may occur.

The additional player hands are examined 28 for substitute cards. For each substitute card in the additional player hands, a replica of the substitute card replaces 34 a card in the other player hand according to the substitution pattern. In one optional embodiment, it is contemplated that the substitution may occur without regard to the effect of the substitution on the receiving hand. That is, the substitute card may be copied into the other player hand according to the substitution pattern whether the poker rank of the receiving hand is increased, decreased, or unaffected by the substitution.

In a separate optional embodiment, the substitution pattern is tested 30 and, if the substitution pattern would yield an equal or higher poker ranking for the receiving hand, the substitution is made.

In yet another optional embodiment, the substitution pattern is tested and, if the substitution pattern would yield a higher poker ranking for the player hand receiving the substitute card, a replica of the substitute card replaces 34 a card in the other player hand. For example, referring to FIGS. 1–6, the cards of the initial player hand and the additional player hands are dealt into five card arrays with the player hands stacked vertically in serial fashion, that is, the first player hand is the lower hand and the additional player hands are located vertically above the first player hand. In the optional embodiment of FIGS. 1–6, the substitution pattern restricts substitute cards to replace cards in other hands that are vertically aligned in a corresponding position with the substitute card. The embodiment of FIGS. 1–6 is described in greater detail below.

Stated another way, replicas of the substitute cards of a player hand are used to replace cards of another player hand, including the first player hand, according to the substitution pattern. In substituting cards, optional conditions may further restrict when substitutions occur: (a) substituting regardless of the effect on the receiving hand; (b) substituting only if the poker rank of the receiving hand is equal or greater after the substitution; or (c) substituting only if the poker rank of the receiving hand is greater after the substitution.

This process is repeated for each additional player hand. It is important to note that the substitute cards themselves will not move into other player hands; rather replicas of the substitute cards will act to replace cards of the other player hands according to the substitution pattern. Consequently, it is entirely possible that a holding of Five of a Kind could be obtained because one or more replicas of substitute card could be copied into a player hand already holding one or more matching substitute cards. It is also important to note that the substitution could take place at any point in the game method. More specifically, while the substitution step in the optional embodiment of FIG. 12 is shown as occurring after the first player hand is played to completion, it is contemplated that the substitution step could occur at any point during the method including before or after drawing cards to a first player hand.

The substitution pattern could take many forms. While the substitution pattern of the optional embodiment shown in FIGS. 1–11 is a "vertically down" pattern, it is contemplated that many other patterns could be use. For example, a "vertically up" pattern, a "vertically up and down" pattern, a diagonal pattern, or any other direction could be used. Additionally, it is contemplated that the substitution pattern could be limited to adjacent hands only or may permit skipping of intermediate hands. Finally, it is contemplated that the substitution pattern may be serial, such as that shown in the embodiment of FIGS. 1–11, in which substitute cards received from another player hand are eligible to act as substitute cards until stopped by a non-substitution caused by the fact that a substitution would not improve the receiving player hand. That is, as shown in FIGS. 1–11, replicas of the substitute cards could cascade downward from the uppermost player hand to the intermediate player hand and into the first player hand.

After the replacements occur, the poker ranking of each player hand is determined and a reward is issued 36. In one optional embodiment, each player hand is rewarded separately such that a player may be rewarded on none, some, or all player hands depending on the poker rank of each individual poker hand. Any suitable pay table may be used for this multiple hand implementation of the poker game. For illustration purposes, representative pay tables are shown in TABLE 1, TABLE 2, and TABLE 3.

It is contemplated that the present invention could be conducted on an electronic gaming machine. Such an electronic gaming machine would include a processor, a display communicating with the processor, an input device, and a data structure storing instructions for the processor, pay-tables, and images of playing cards. In such an embodiment, the processor would display the hands at the display and selections would be made using buttons on the button panel of the gaming device, a touch screen, or other input device.

Reference is now made to two complete games shown in FIGS. 1–6 and 7–11, respectively. Referring first to FIGS. 1–6, in this example game of an optional embodiment all cards that have the rank of Ace have been designated as substitute cards and the substitution pattern directs that substitute cards may replace vertically aligned cards in the next lower hand if it improves the poker rank of the next lower hand. FIG. 1 shows the layout for the first player hand in this example game. The player has made three wagers: the first wager is on the bottom row 100, the second wager is on the middle row 110, and the third wager is on the upper row 120. Thus, the player is playing three hands. Three rows of cards are initially dealt. The bottom row 100 is dealt face up; the middle row 110 and the upper row 120 are dealt face down. It is noted here that the middle row 110 and upper row 120 need not have been dealt face down and could have, in fact, been dealt face up.

Figure 2:
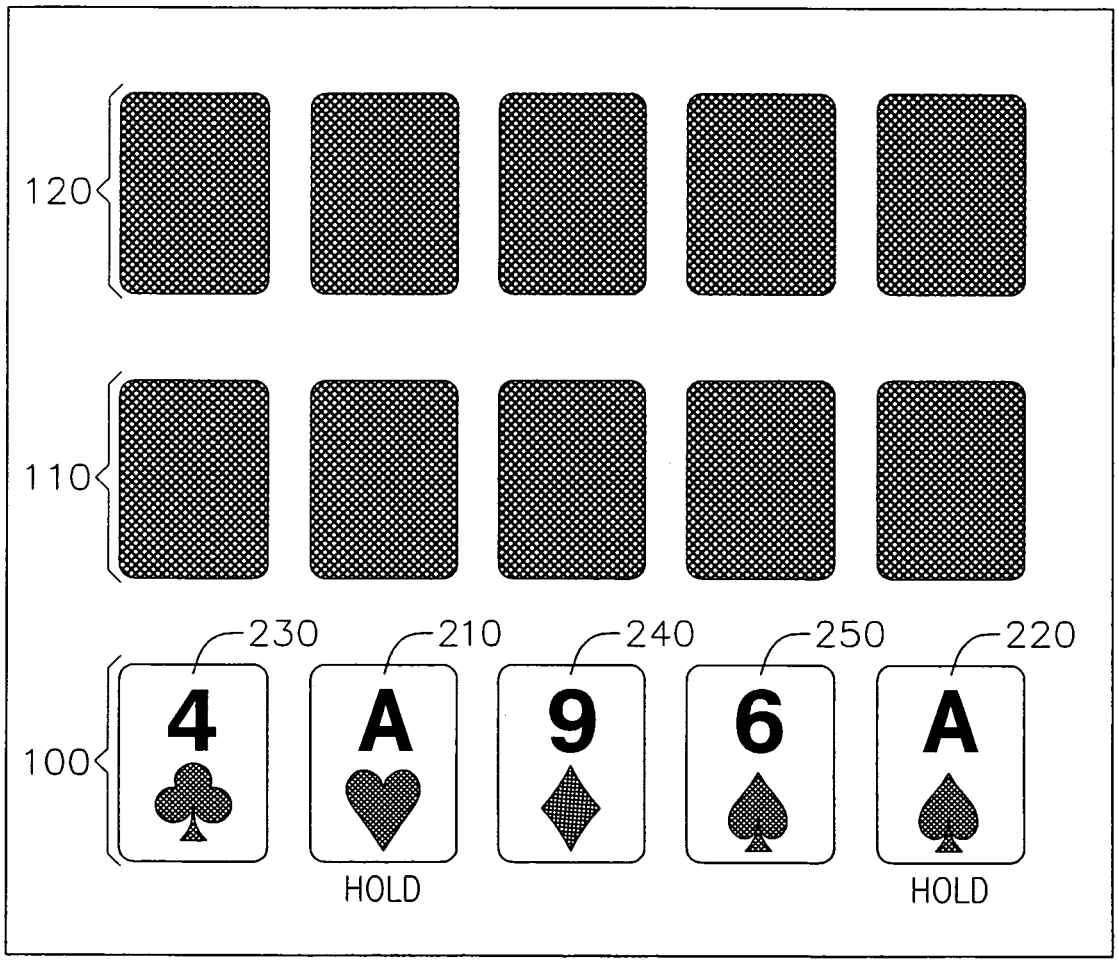
FIG. 2 shows a screen display according to the embodiment of FIG. 1 after the player has selected the cards he wishes to hold from the bottom row.
Figure 3:
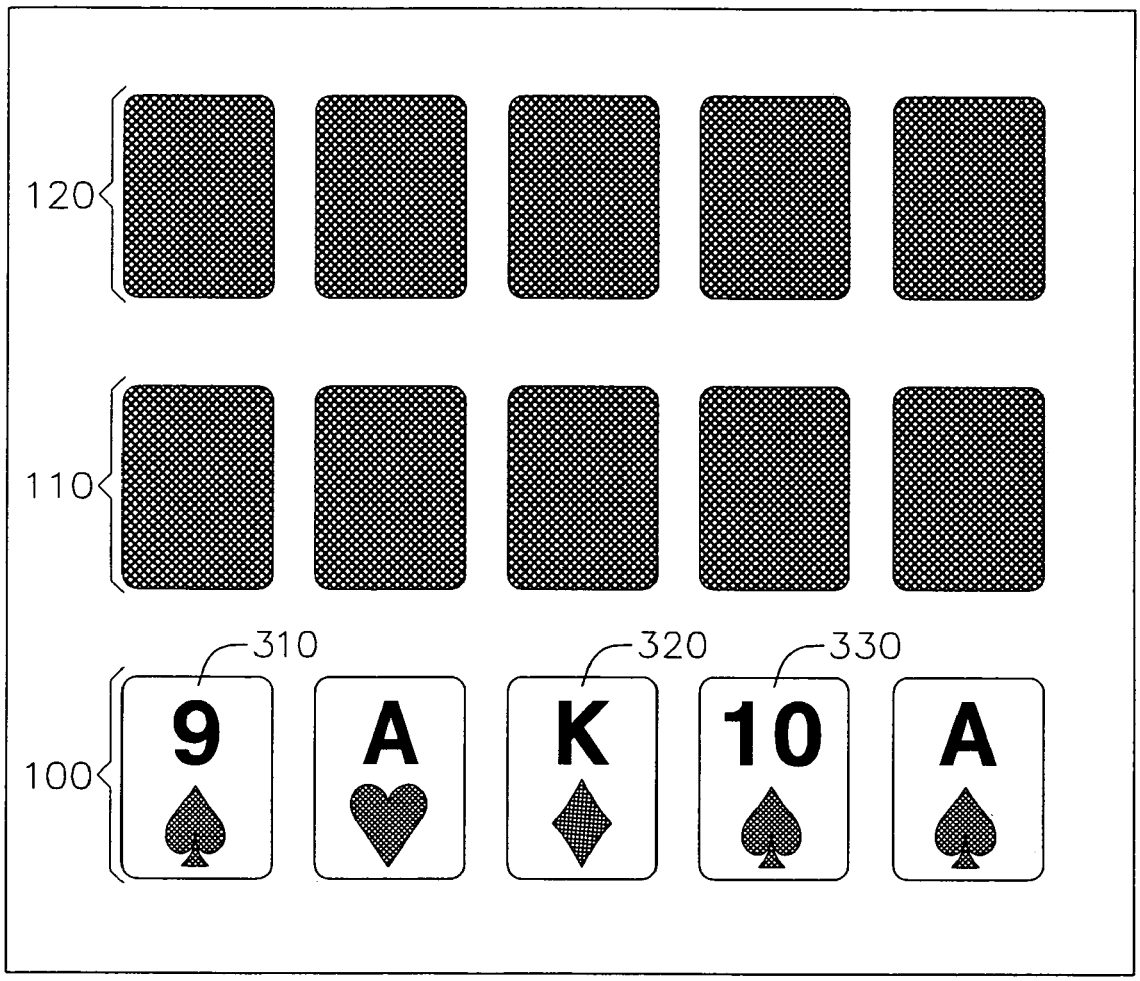
FIG. 3 shows a screen display according to the embodiment of FIG. 1 after the replacement cards were issued for the bottom row.

The player selects those cards in the bottom row 100, i.e. the first player hand, that he wishes to hold. The player may elect to hold from zero to five cards from the bottom row 100. FIG. 2 shows the cards Ace of Hearts 210 and Ace of Spades 220 that were selected to be held from the bottom row 100. Cards not selected to be held 230 240 250 will be replaced with new cards dealt face up to the bottom row 100. FIG. 3 shows the hand of the bottom row 100 with the new replacement cards 310, 320, 330.

Figure 4:
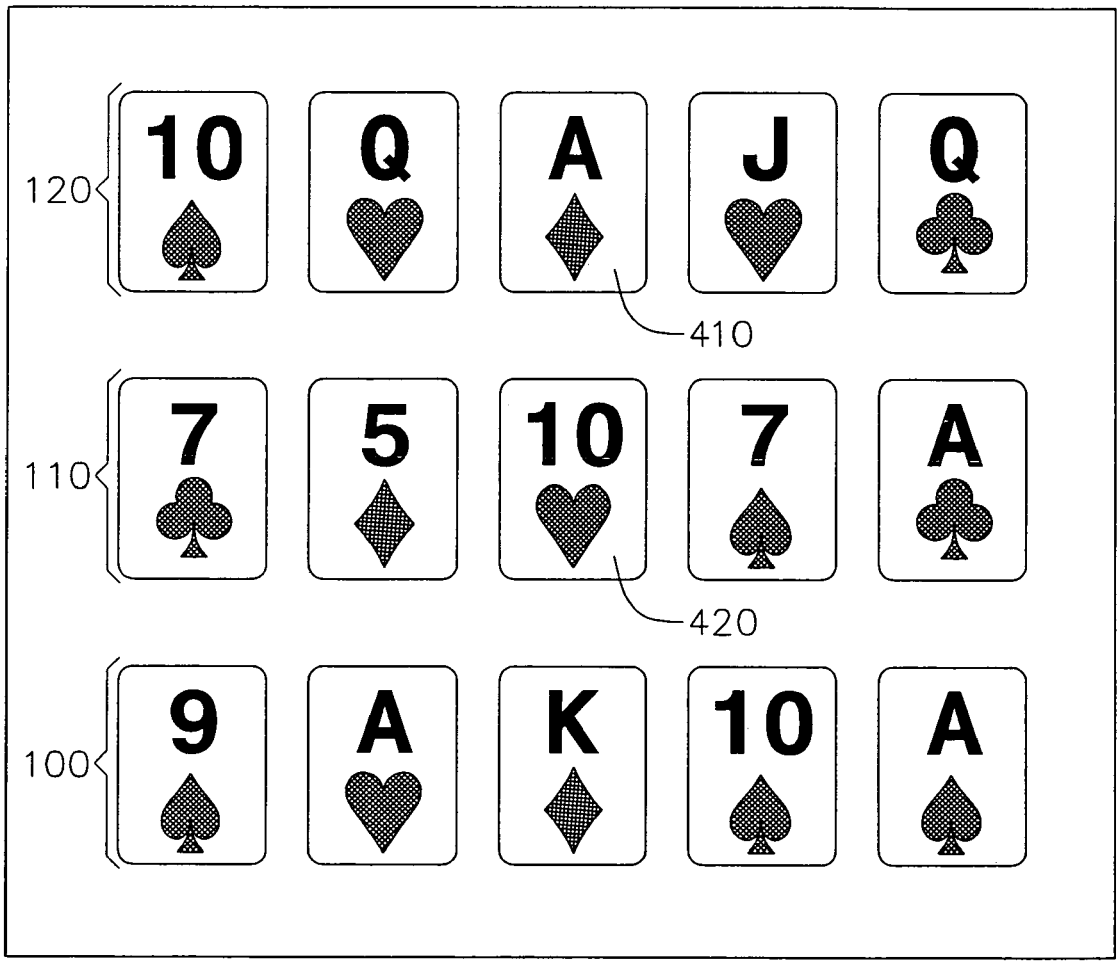
FIG. 4 shows a screen display according to the embodiment of FIG. 1 after the cards in the upper row and middle row have been revealed.

FIG. 4 shows the additional player hands in the middle row 110 and the upper row 120 after the replacement cards were issued for the bottom row 100. The screen displays the fifteen cards comprising the three separate poker hands 100, 110, 120. The upper hand 120 contains the Ace of Diamonds 410 which has been designated as a bonus card for this example game of an optional embodiment.

Figure 5:
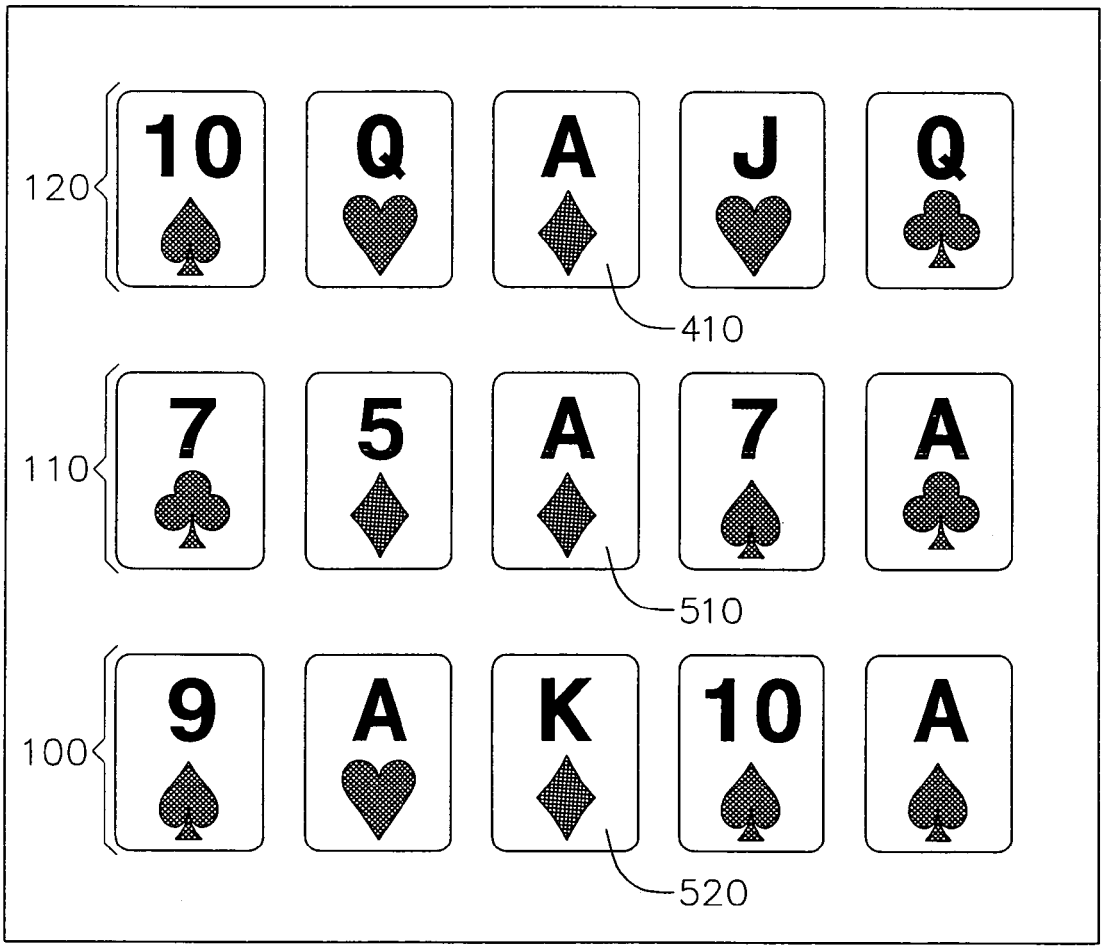
FIG. 5 shows a screen display according to the embodiment of FIG. 1 after the Ace of Diamonds in the upper row has been duplicated and replaced the Ten of Hearts in the middle row.

FIG. 5 shows that the Ace of Diamonds 410 from the upper row 120 has been replicated and has replaced the Ten of Hearts 420 (FIG. 4) from the middle row 110. This replacement has happened because by replacing the Ten of Hearts 420 (FIG. 4) with the Ace of Diamonds 510 we have improved the rank of the middle hand 110 from a pair of Sevens to a hand ranking as two pair, Aces and Sevens.

Figure 6:
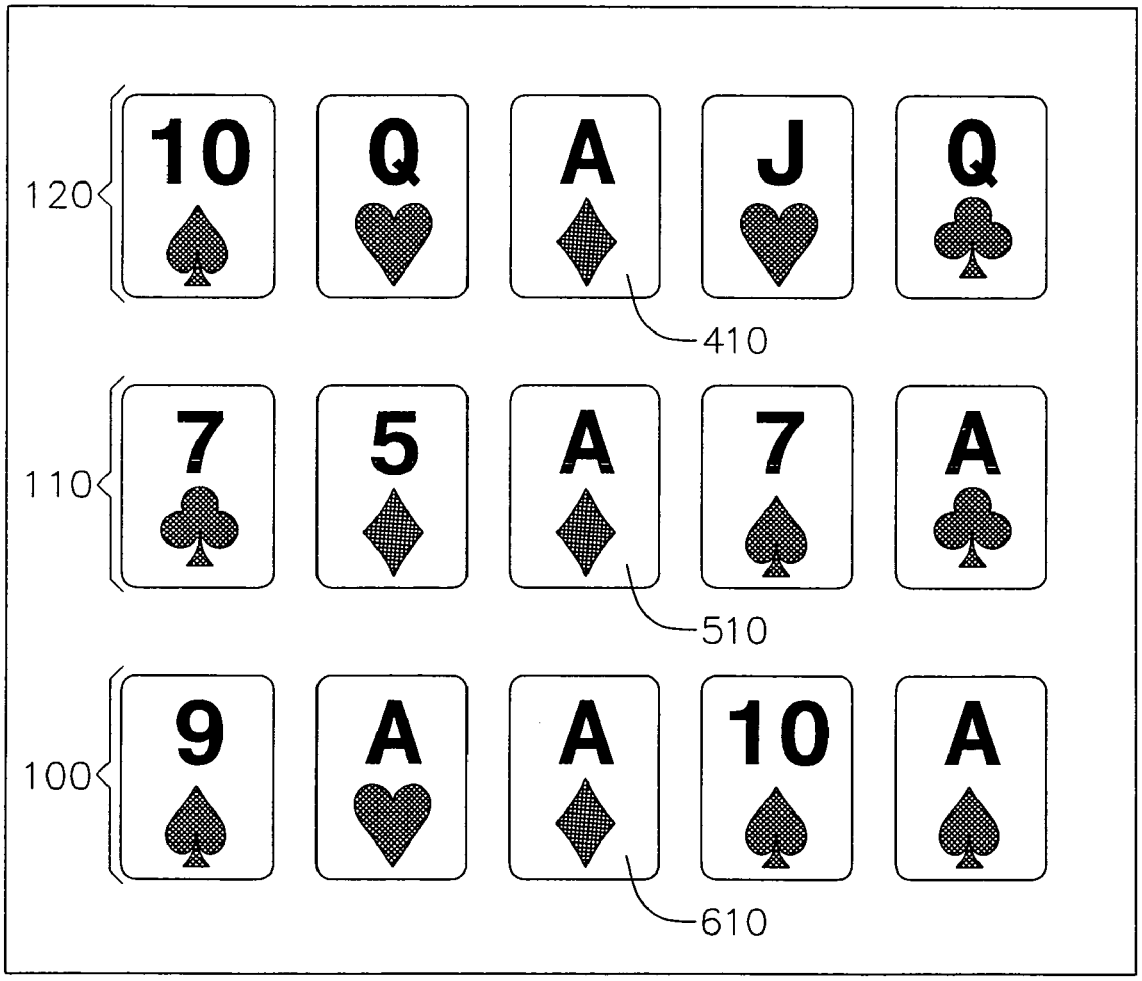
FIG. 6 shows a screen display according to the embodiment of FIG. 1 after the Ace of Diamonds in the middle row has been duplicated and has replaced the King of Diamonds in the bottom row.

FIG. 6 shows that the Ace of Diamonds 510 from the middle hand 110 has been duplicated and has replaced the King of Diamonds 520 (FIG. 5) from the bottom hand 100. This replacement has happened because by replacing the King of Diamonds 520 (FIG. 5) with the Ace of Diamonds 610 the rank of the lower hand 100 has improved from a Pair of Aces to Three of a Kind Aces. Had the Ace of Diamonds 510 not improved the bottom hand 100, the replication and replacement would not have occurred. At this point the games is over and all three hands in which the player wagered on will be evaluated and paid according to the pay schedule.

FIGS. 7–11 illustrate another example game of an optional method of play of the present invention. In this embodiment, all cards of rank Ace are designated to be substitute cards and the substitution pattern directs that substitute cards may replace any vertically aligned card from any hand lower than the hand with the substitute card if by doing so it would improve the poker hand rank of the lower hand.

Figure 7:
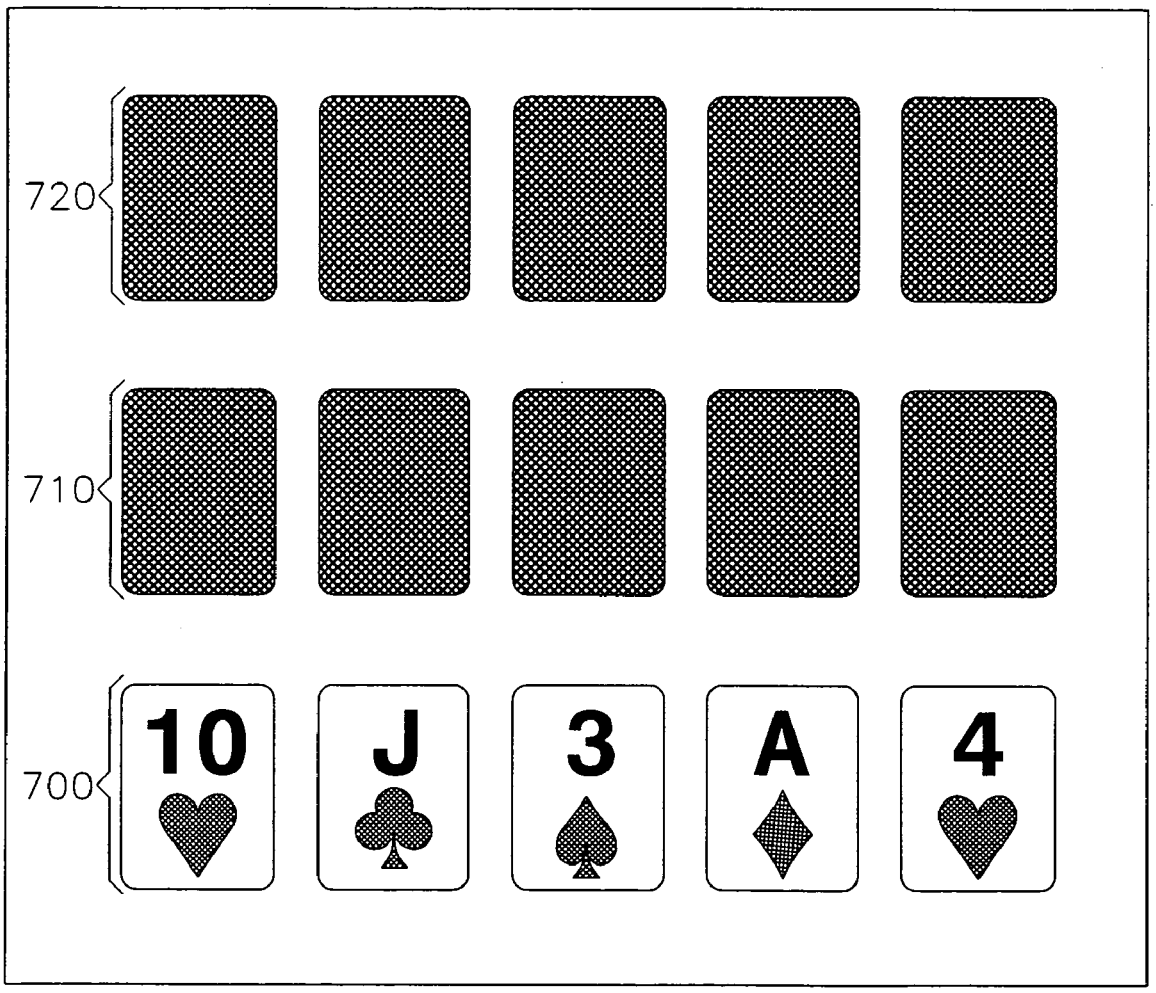
FIG. 7 shows a screen display according to an alternate embodiment of the present invention after an initial deal of the cards.

FIG. 7 shows three rows of cards that are initially dealt with the first player hand 700 having its cards dealt face up. The middle hand 710 and the upper hand 720 are dealt face down. Again, the middle row 710 and upper row 720 need not have dealt face down and could have been dealt face up.

Figure 8:
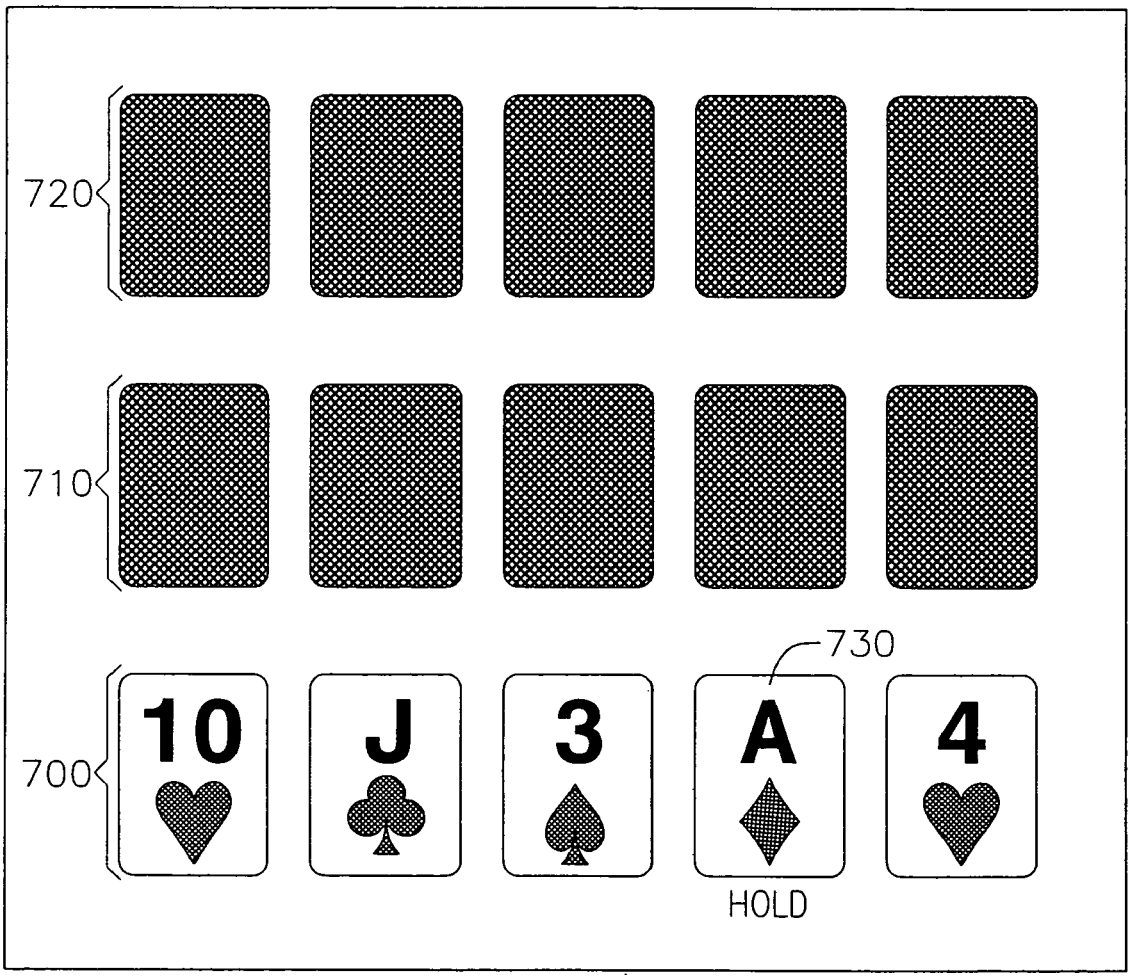
FIG. 8 shows a screen display according to the embodiment of FIG. 7 after the player has selected the cards he wishes to hold from the bottom row.

FIG. 8 shows that the player has selected to hold the Ace of Diamonds 730.

Figure 9:
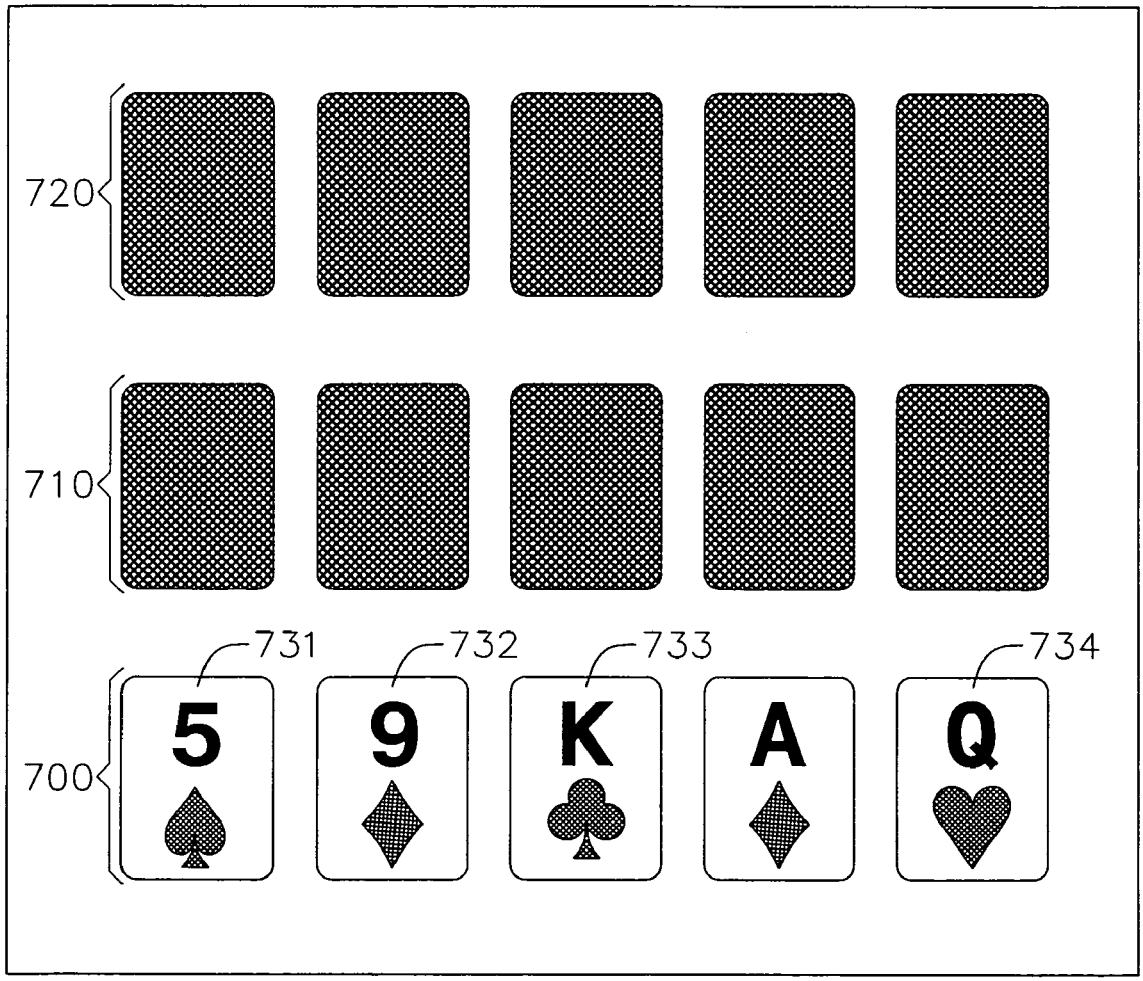
FIG. 9 shows a screen display according to the embodiment of FIG. 7 after the replacement cards were issued for the bottom row.

FIG. 9 shows that the player has received new cards 731, 732, 733, 734 in the first player hand 700 for the cards the player did not select to keep before pressing the "deal" button.

Figure 10:
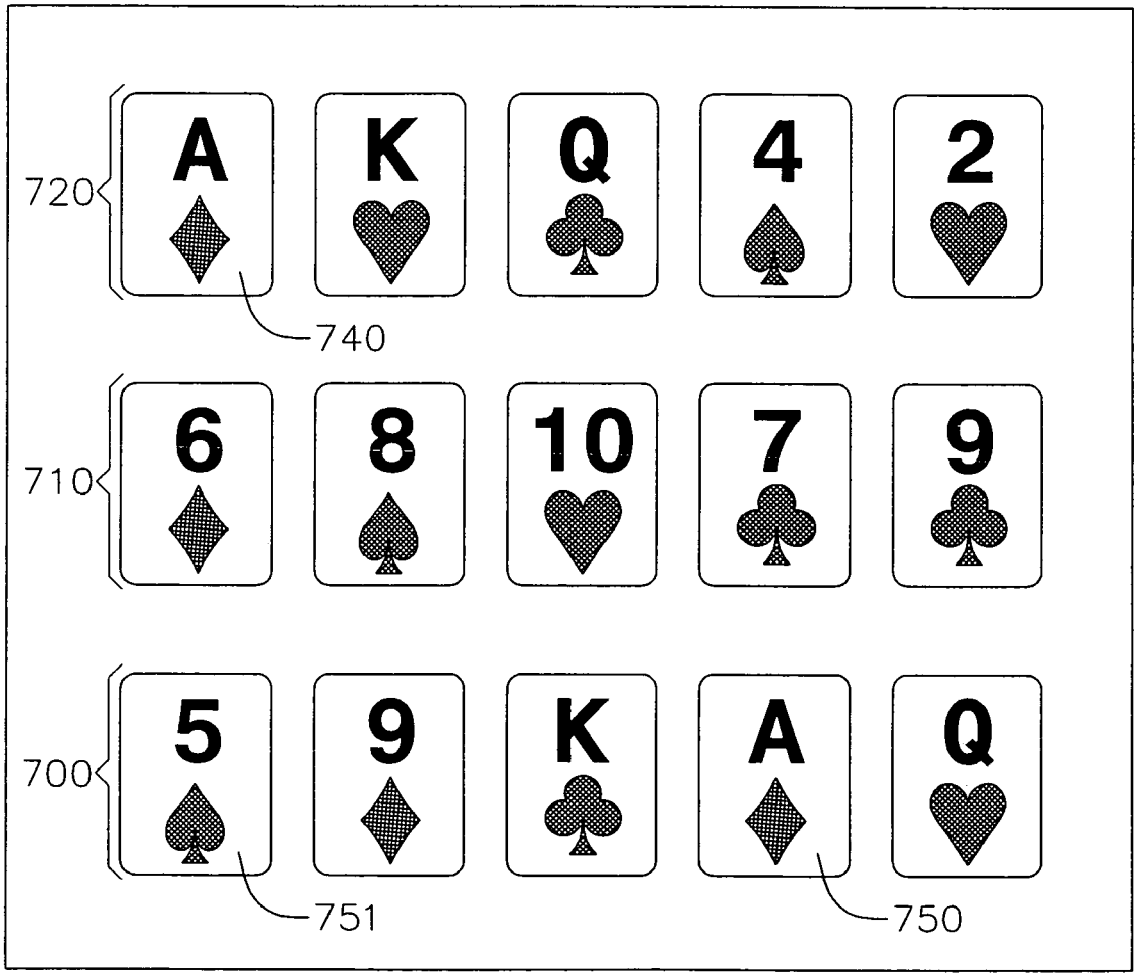
FIG. 10 shows a screen display according to the embodiment of FIG. 7 after the cards in the upper row and middle row have been revealed.

FIG. 10 shows the screen after the "deal" button has been pressed with all of the cards revealed for both the upper hand 720 and the middle hand 710. We also see that the player has received an Ace of Diamonds 740 a substitute card in the upper hand 720 and the player was dealt an Ace of Diamonds 750 a substitute card in the bottom hand 700.

Figure 11:
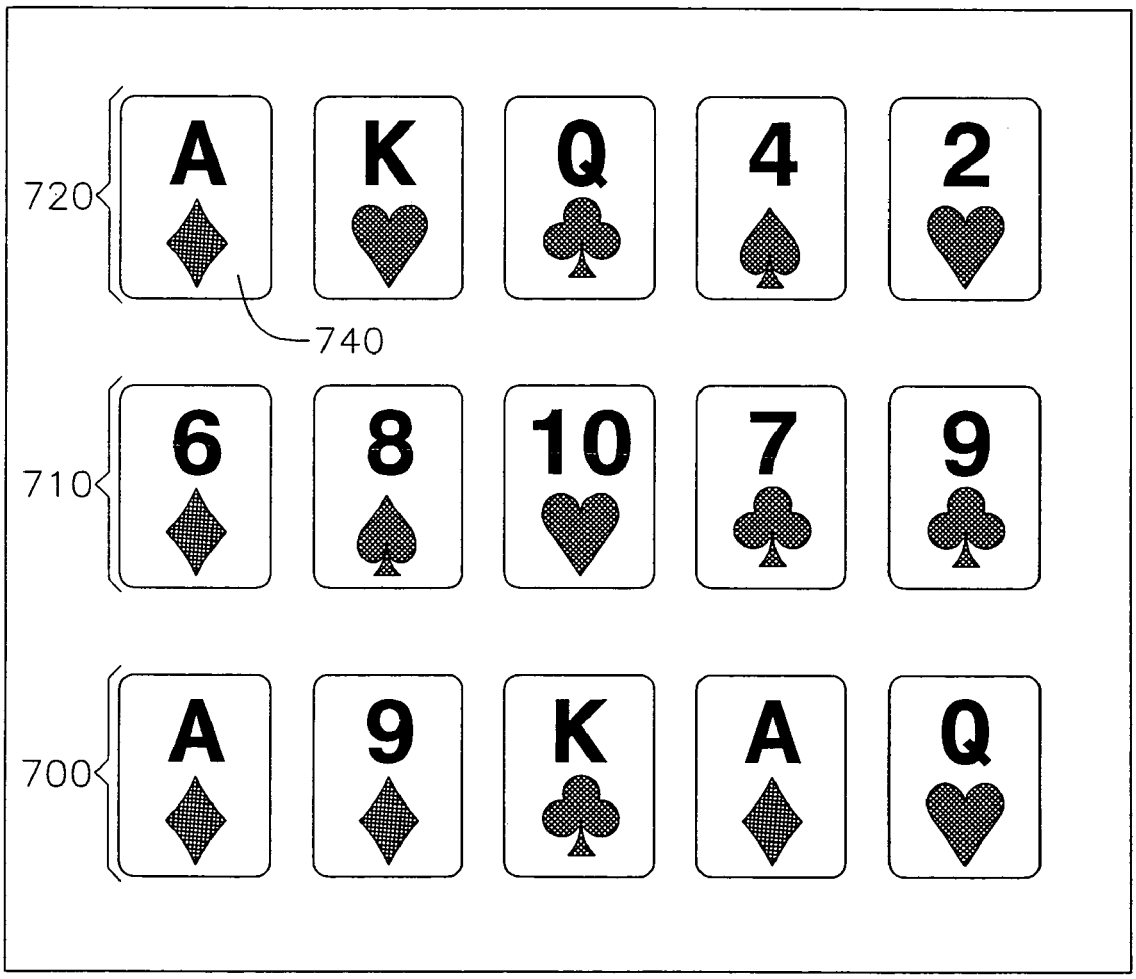
FIG. 11 shows a screen display according to the embodiment of FIG. 7 after the Ace of Diamonds in the upper row has been duplicated and has replaced the Five of Spades in the bottom row.
Figure 12:
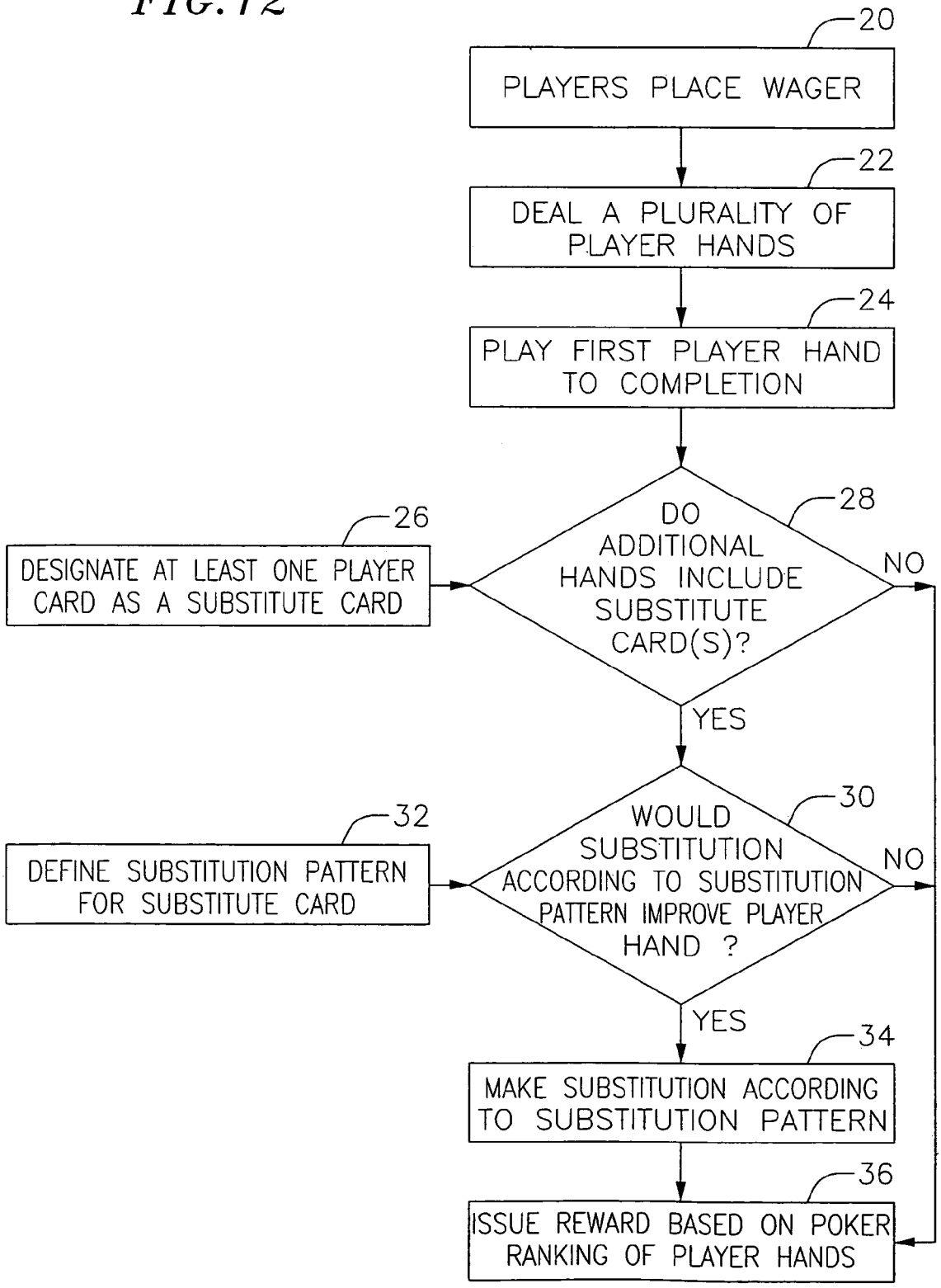
FIG. 12 shows a flowchart according to an embodiment of the method of the present invention.

FIG. 11 shows that the Ace of Diamonds 740 from the upper hand 720 has been replicated and has replaced the Five of Spades 751 (FIG. 10) because by doing so it has improved the rank of the bottom hand 700 from an Ace High hand to a hand that ranks as a Pair of Aces. Also notice that the Ace of Diamonds 740 did not replicate itself into the middle hand 710 because it would not have improved the rank of the middle hand 710 because it already ranks as a Straight.

At this point the game is over and the player would be rewarded for the winning hands of Straight for the middle hand 710 and a Pair of Aces in the first player hand 700.

Figure 19:
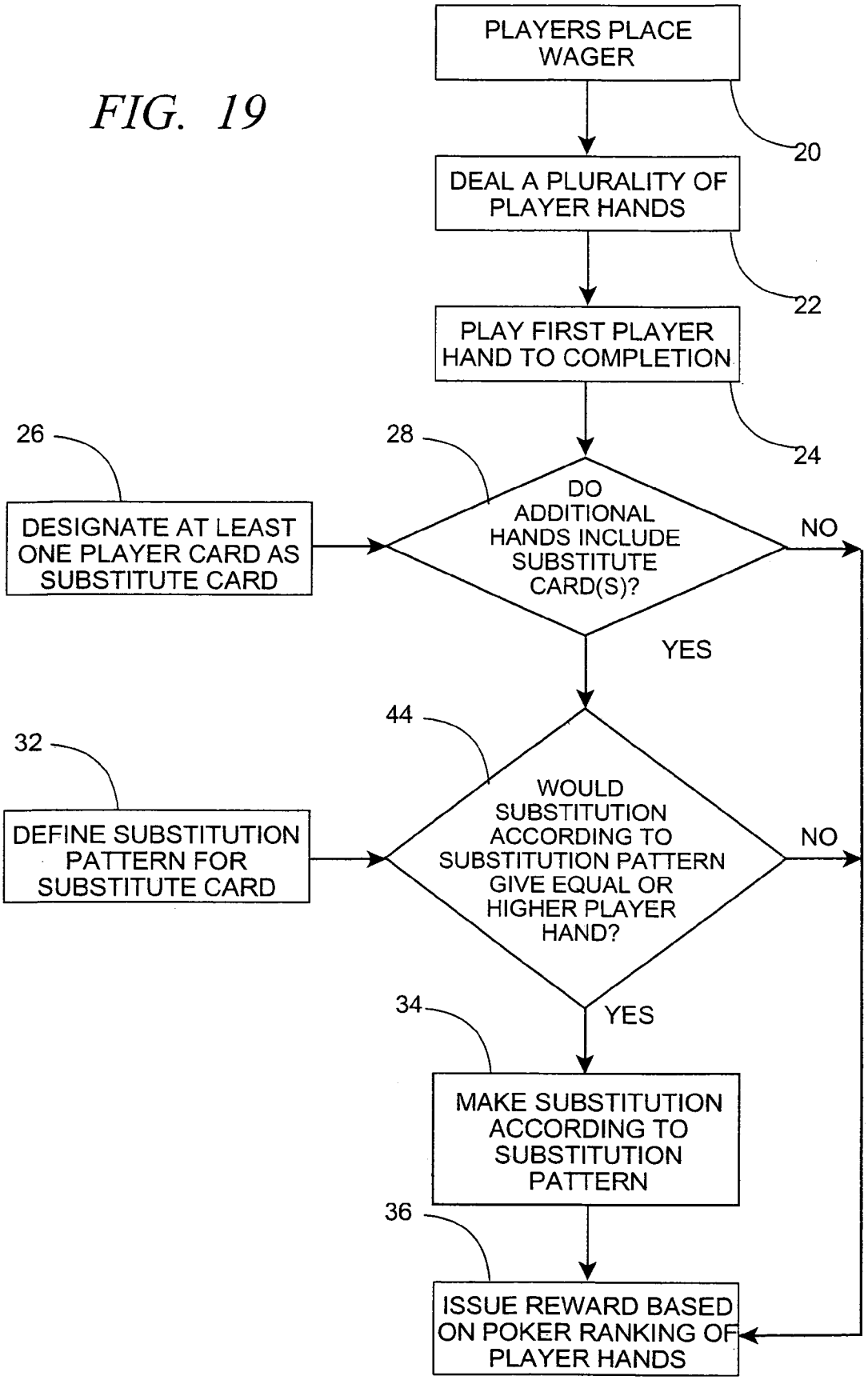
FIG. 19 shows a flowchart of a method according to another embodiment of the present invention.
Figure 20:
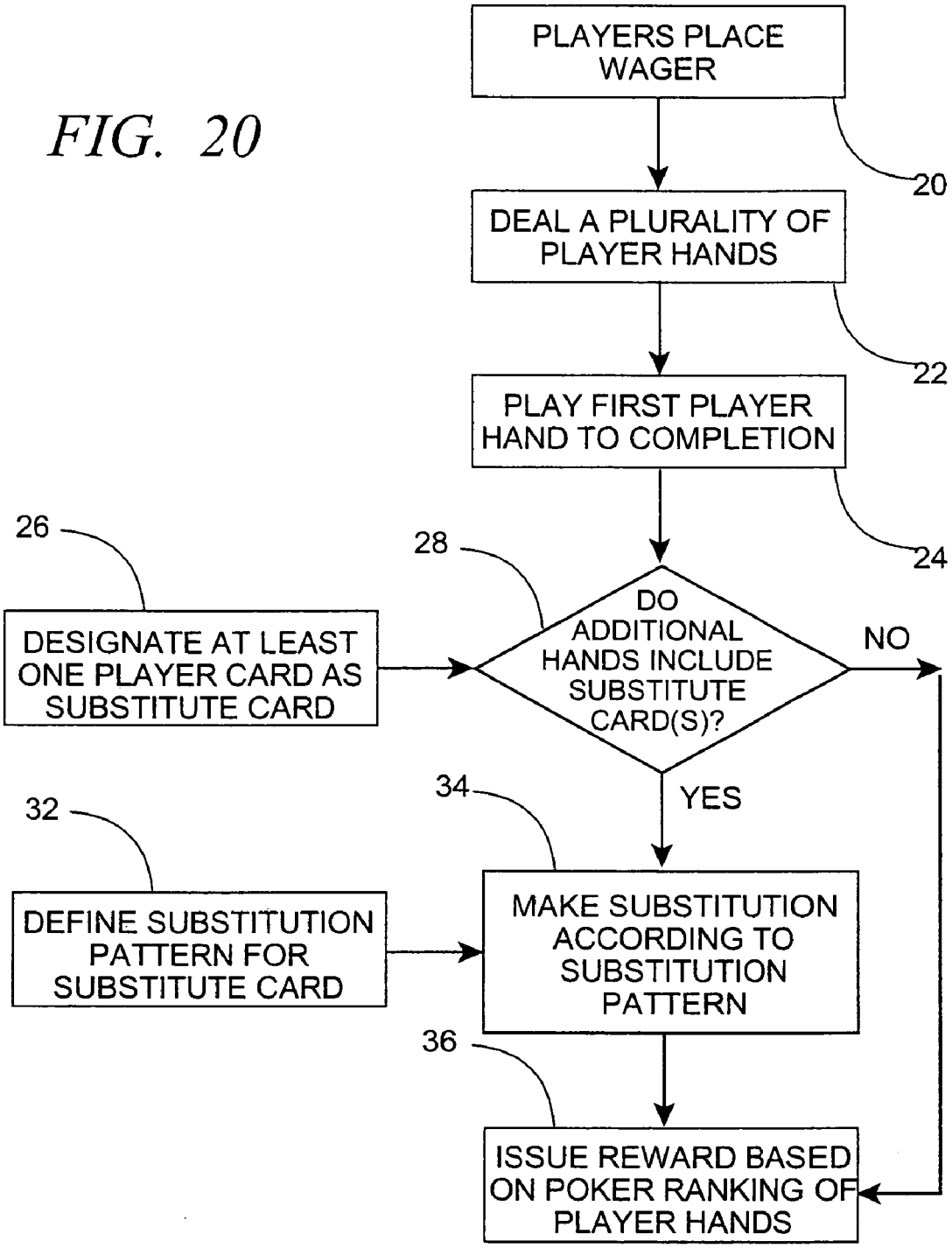
FIG. 20 shows a flowchart of a method according to another embodiment of the present invention.

Alternate forms of the method are shown in the flowcharts of FIGS. 19 and 20. With reference to FIG. 19, the substitution 34 will occur only if the poker ranking of the receiving hand is improved or unaffected 44. That is, the substitution 34 occurs when the poker ranking of the receiving hand is equal or greater after the substitution 44.

Figure 13:
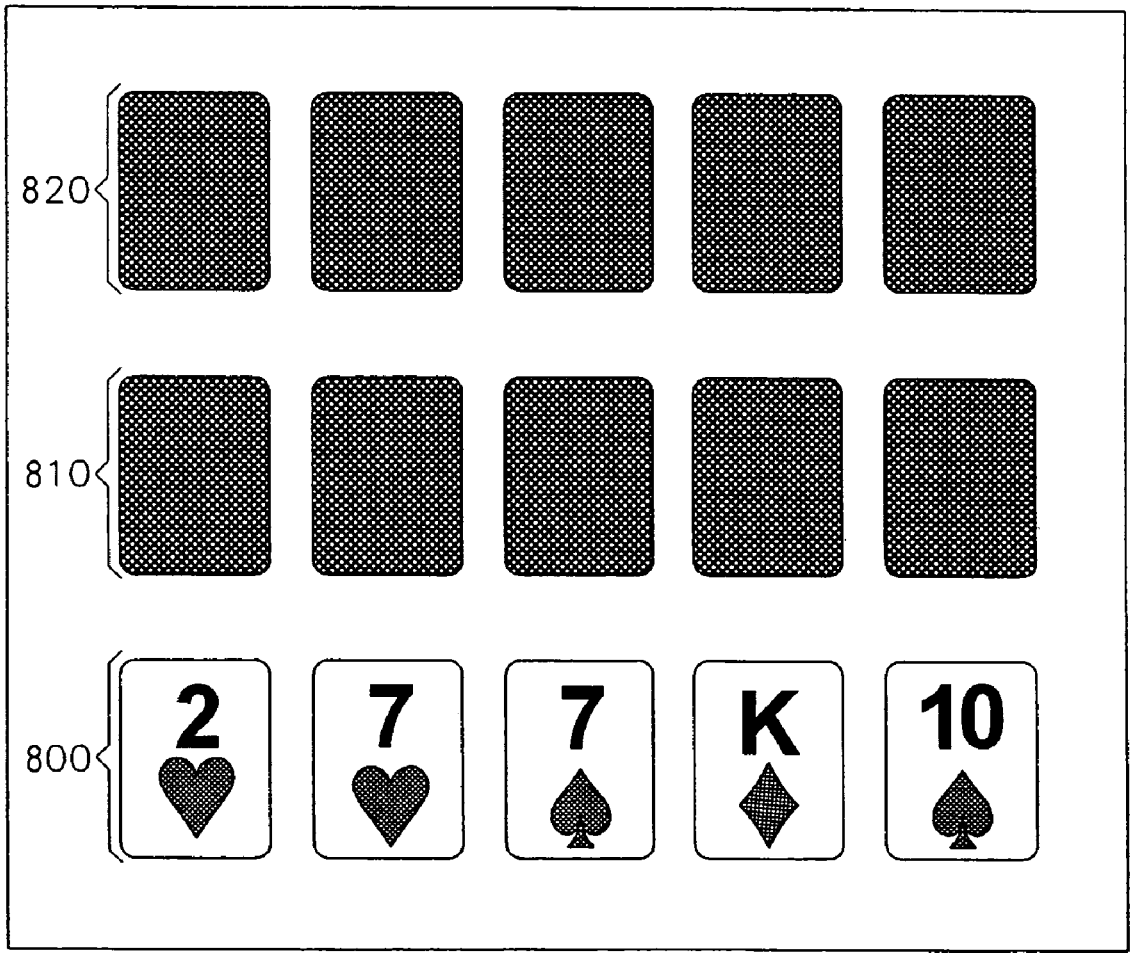
FIG. 13 shows a screen display according to an alternate embodiment of the present invention after an initial deal of cards.

An example game according to the optional embodiment of FIG. 19 is shown in FIGS. 13–18. For the purposes of this example, all cards that have the rank of Ace have been designated as substitute cards and the substitution pattern directs that substitute cards may replace vertically aligned cards. FIG. 13 shows the initial deal for the first player hand in this example game. The player is playing three rows of cards, a bottom row 800, a middle row 810, and a upper row 820. Again, although the bottom row 800 is dealt face up and the middle row 810 and the upper row 820 are dealt face down, it is contemplated that all three rows 800, 810, 820 could have been dealt face up.

Figure 14:
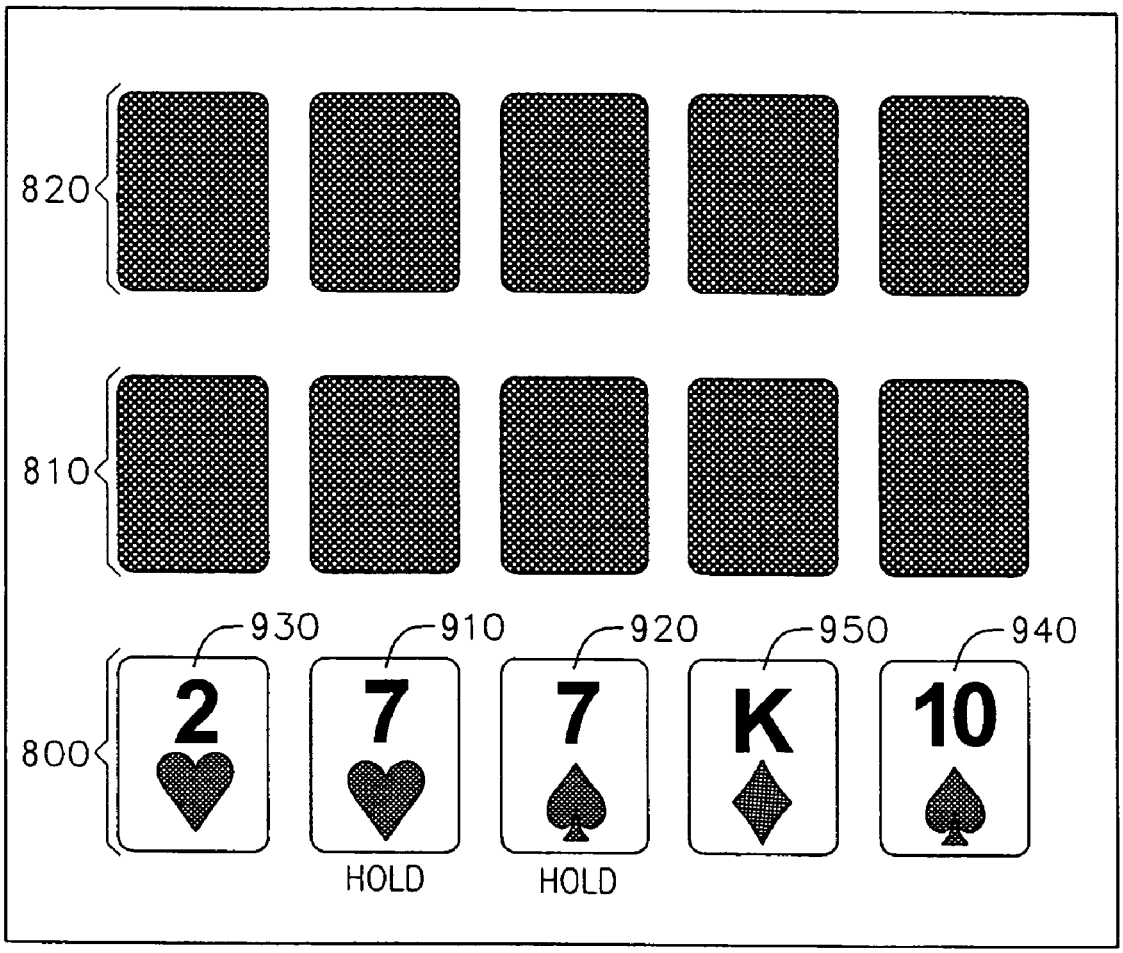
FIG. 14 shows a screen display according to the embodiment of FIG. 13 after the player has selected the cards he wishes to hold from the bottom row.
Figure 15:
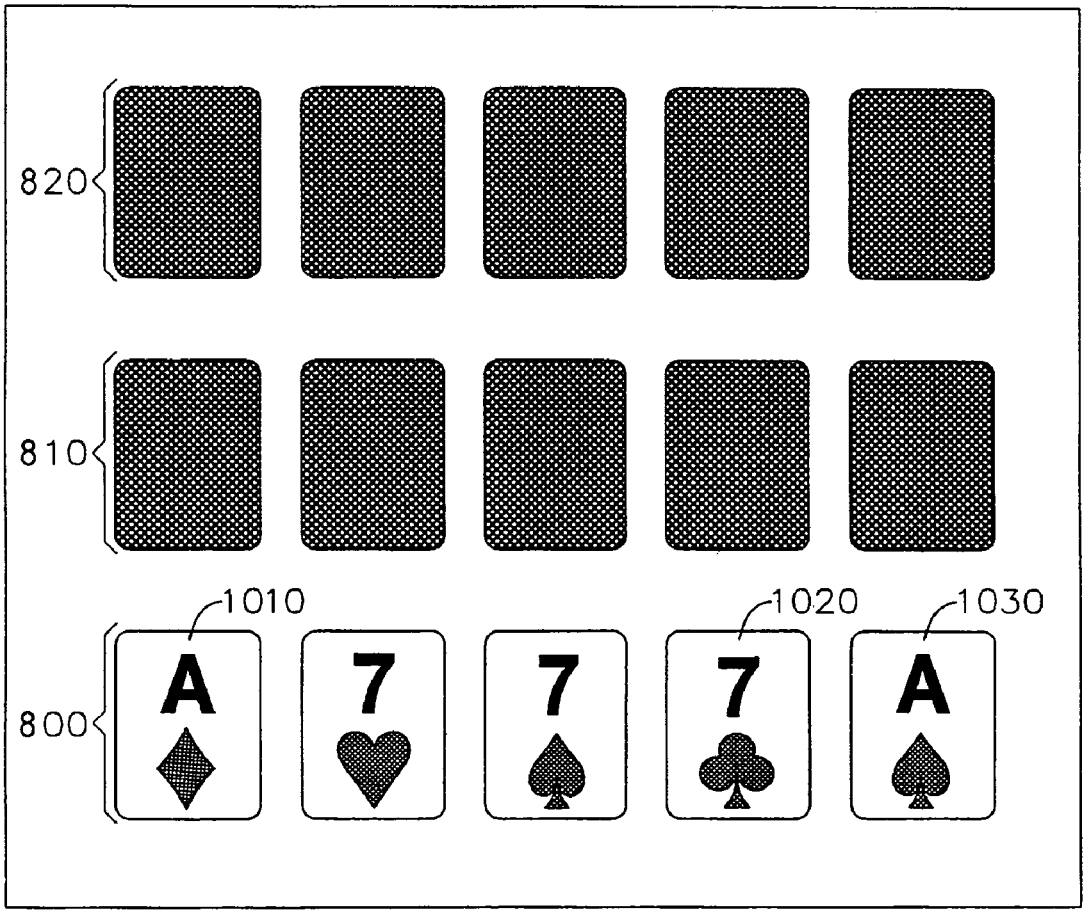
FIG. 15 shows a screen display according to the embodiment of FIG. 13 after the replacement cards were issued for the bottom row.

This particular embodiment is based on draw poker, although stud poker, or any other form of card game could be used. The player selects those cards in the bottom row 800, i.e. the first player hand, that he wishes to hold. The player may elect to hold from zero to five cards from the bottom row 800. As illustrated in FIG. 14, the player has held the cards Seven of Hearts 210 and Seven of Spades 220 from the bottom row 100. The remaining cards 930, 940, 950 will be discarded and replaced with new cards. FIG. 15 shows the hand of the bottom row 100 after the replacement cards 1010, 1020, 1030 have been dealt.

Figure 16:
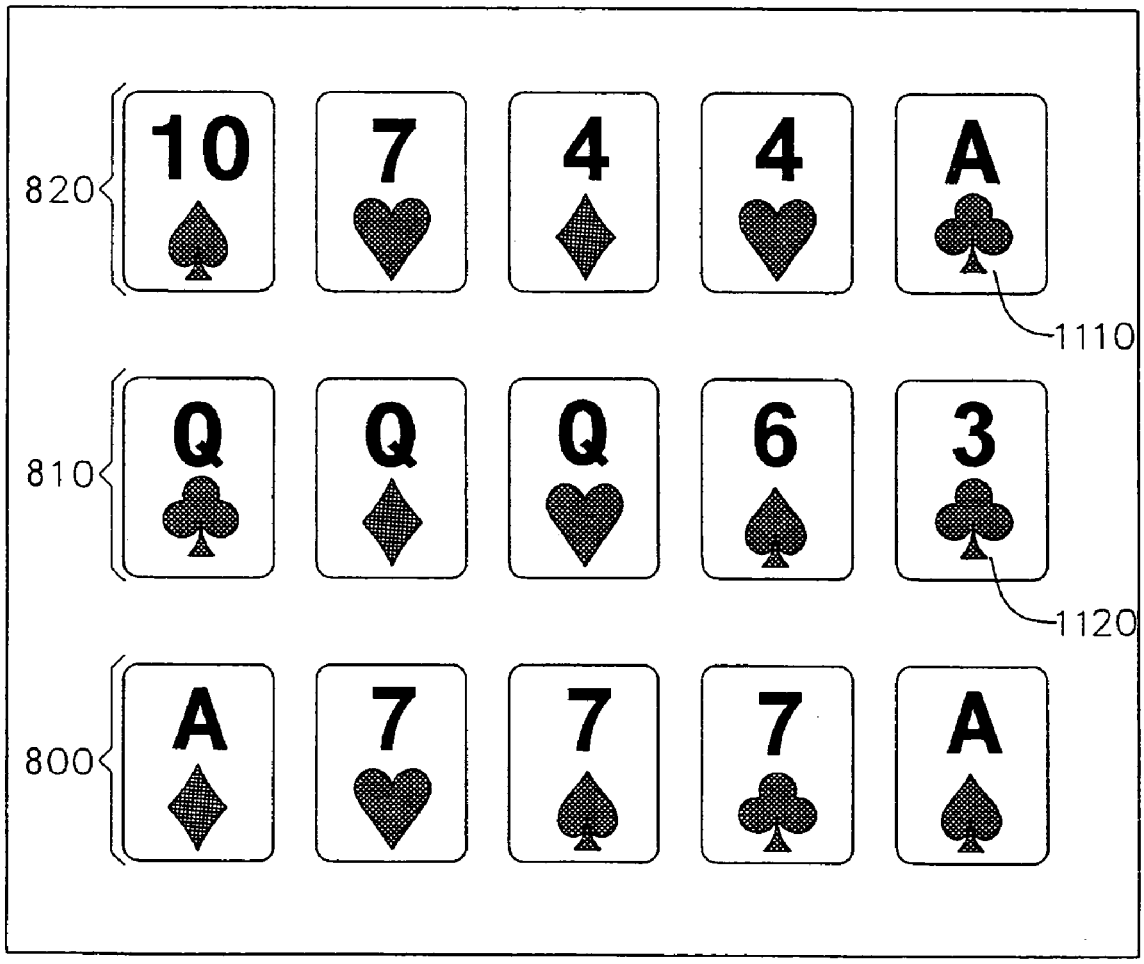
FIG. 16 shows a screen display according to the embodiment if FIG. 13 after the cards in the upper row and middle row have been revealed.

FIG. 16 shows the additional player hands in the middle row 810 and the upper row 820. The upper hand 820 holds an Ace of Clubs. Since cards having a rank of Ace are designated substitute cards, the Ace of Clubs could be duplicated into the other hands according to the substitution rule.

Figure 17:
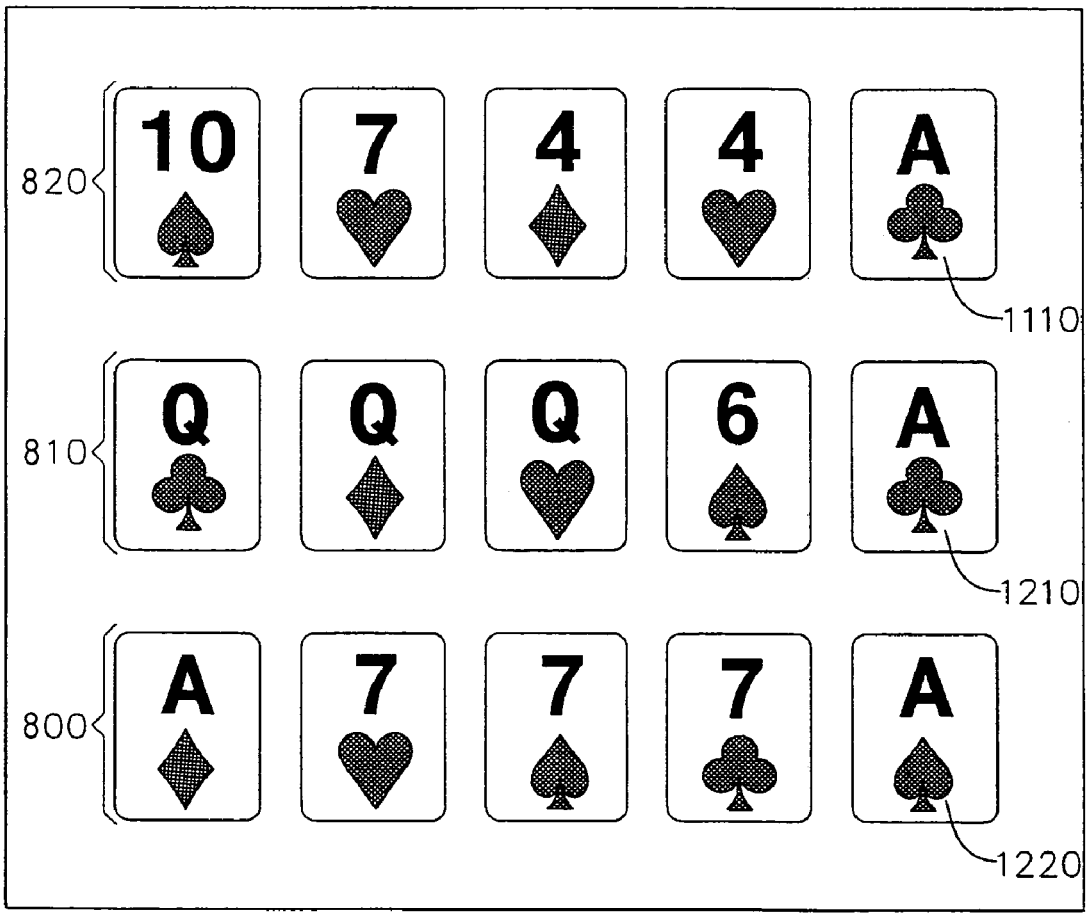
FIG. 17 shows a screen display according to the embodiment of FIG. 13 after the Ace of Clubs has been replicated from an upper row to a middle row.

FIG. 17 shows that the Ace of Clubs 1010 from the upper row 820 has been replicated and has replaced the card vertically aligned below it in the middle row 810, formerly a Three of Clubs 1120 as shown in FIG. 16. Recalling that this embodiment allows substitution when the poker rank of the receiving hand is equal or greater after the substitution, this replacement has happened because by replacing the Three of Clubs 1120 (FIG. 16) with the Ace of Clubs 1210, the resulting poker rank of the middle hand 810 was greater after the substitution.

Figure 18:
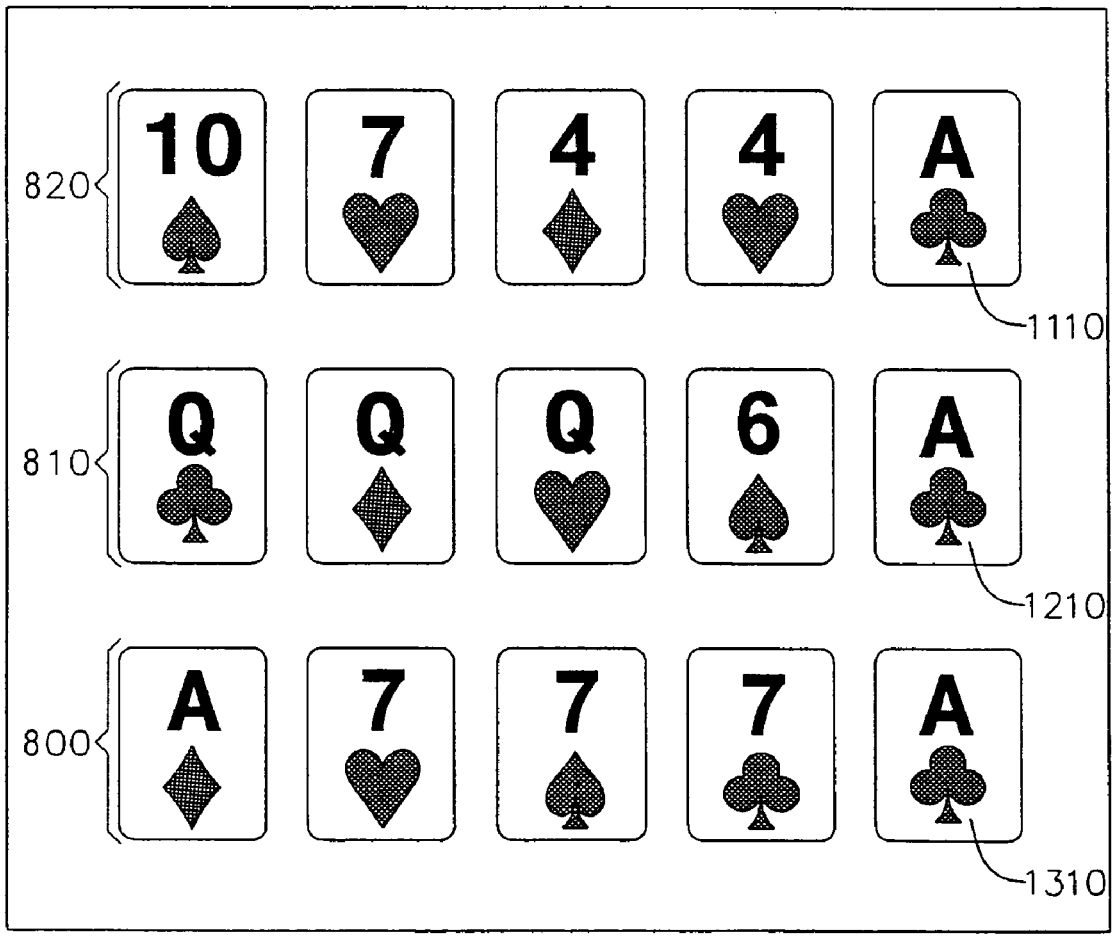
FIG. 18 shows a screen display according to the embodiment of FIG. 13 after the Ace of Clubs has been replicated from a middle row to a bottom row.

FIG. 18 shows that the Ace of Clubs 1210 from the middle hand 810 has been duplicated and has replaced the Ace of Spades 1220 (FIG. 17) from the bottom hand 800. Although this substitution has had no effect on the poker rank of the receiving hand, the replacement has occurred nonetheless because the rule permits substitution if the poker rank is unaffected. In this case, the bottom hand 800 has a poker rank of Full House, Sevens over Aces, both before and after the substitution. Therefore, this replacement has happened because by replacing the Ace of Spades 1220 (FIG. 17) with the Ace of Clubs 610 the rank of the lower hand 100 is unaffected. In this example embodiment, the Ace of Clubs 510 would have not been replicated into the bottom hand 800 if the substitution had resulted in a decreased poker rank.

However, it is contemplated that even this rule may be altered. With reference to FIG. 20, the substitution will occur without regard to the poker ranking of the receiving hand. That is, the substitution occurs whether the poker ranking of the receiving hand is higher, equal, or lower after the substitution. This method differs from the embodiments of FIGS. 12 and 19 in that the hands need not be examined to determine how a substitution would affect the poker ranking of the receiving hand.

Thus, the method could include a substitution rule in which a substitute card: (a) substitutes if the substitution results in an improved poker ranking of the receiving hand, shown in FIG. 12 and illustrated in the example games of FIGS. 1–6 and 7–11; (b) substitutes if the substitution results in an improved or equal poker ranking of the receiving hand, shown in FIG. 19 and illustrated in the example game of FIGS. 13–18; or (c) substitutes regardless of the effect on the poker ranking of the receiving hand, shown in FIG. 20.

An example hand of another embodiment is given in FIGS. 21–24. As noted above, the game method of the present invention is not limited to any particular number of hands. Thus, this optional embodiment includes two player hands, a bottom hand 1400 and a upper hand 1410.

This optional embodiment also illustrates an example in which both the bottom hand 1400 and the upper hand 1410 are dealt face up. That is, rather than dealing one hand face up and the remaining hands face down, as shown in the optional embodiments of FIGS. 1–6, 7–11, and 13–18, the optional embodiment shown in FIGS. 21–24 begins with the hands being dealt face up.

As shown in FIGS. 21–24, each hand 1400, 1410 need not be of equal size or be resolved using the same hand rankings. In the optional embodiment shown, the bottom hand 1400 includes five cards, while the upper hand 1410 includes three cards aligned with the second, third, and fourth cards of the bottom hand 1400. It is contemplated, however, that the number of cards in each hand and the relative positioning of the hands with respect to one another could vary from those shown.

Before stepping through the example of FIGS. 21–24, it is noted that the bottom hand 1400 of this optional embodiment is played according to the rules of draw poker. However, it is contemplated that any card game could be used to complete the bottom hand 1400 including stud poker, hold 'em poker, other forms of poker, or any other form of card game.

Also, it is noted that the substitution pattern used in the example of the optional embodiment of FIGS. 21–24 is that any card may substitute for a card vertically aligned below, if the poker ranking of the receiving hand is improved, or unaffected, by the substitution, as illustrated by the flowchart of FIG. 19.

Figure 21:
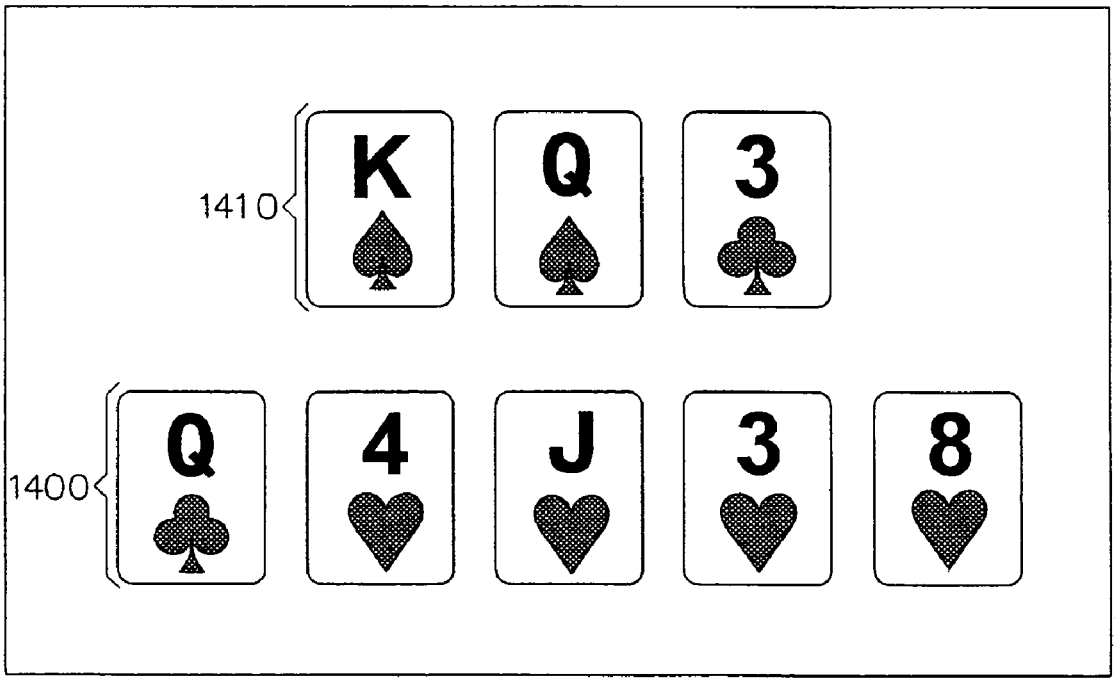
FIG. 21 shows a screen display according to an alternate embodiment of the present invention after an initial deal of cards.
Figure 22:
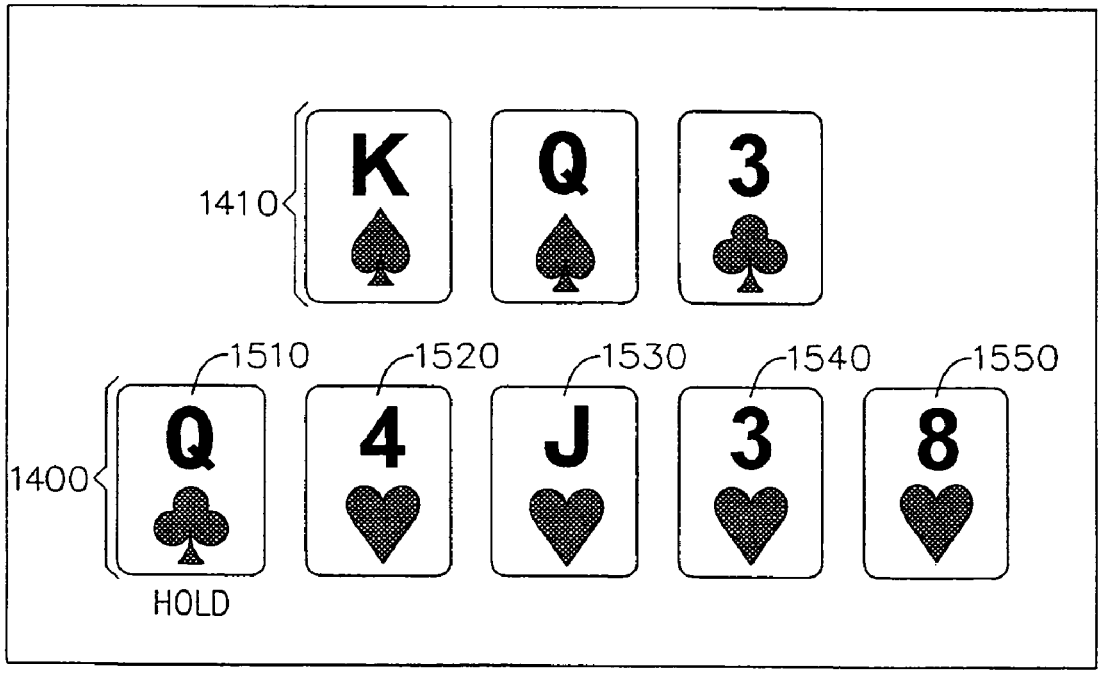
FIG. 22 shows a screen display according to the embodiment of FIG. 21 after the player has selected the cards he wishes to hold from the bottom row.

Referring to FIGS. 21 and 22, the initial deal of the bottom hand 1400 includes Queen of Clubs, Four of Hearts, Jack of Hearts, Three of Hearts, and Eight of Hearts, while the initial deal of the upper hand 1410 includes King of Spades, Queen of Spades, and Three of Clubs. Since this optional embodiment utilizes a draw poker format for the bottom hand 1400, the player has a number of options for playing the bottom hand to completion.

For example, the player may choose to hold the Four of Hearts 1520, Jack of Hearts 1530, Three of Hearts 1540, and Eight of Hearts 1550 and attempt to draw for a flush. Depending upon the draw and the paytable, the player may win even if a card of Heart suit is not drawn. The player could draw a Jack for a pair of Jacks or the player could draw a King, in which case the King of Spades from the middle hand could substitute into the bottom hand 1400 to give the player a pair of Kings.

Alternatively, as shown in FIG. 22, the player may choose to hold the Queen of Clubs 1510. Because of the composition of the upper hand 1410, the player is guaranteed at least a pair of Queens if the player holds the Queen of Clubs 1510. This occurs because the Queen of Spades from the upper hand 1410 will substitute for any card below it if the player cannot obtain a hand higher than a pair of Queens after the draw. That is, suppose the Queen of Clubs 1510 is held and the player finishes with a bottom hand of Queen of Clubs 1510 and four unmatched, unsuited, non-consecutive cards. The Queen of Spades from the upper hand 1410 will substitute into the bottom hand 1400 to "raise" the poker rank of the bottom hand 1400 from Queen-high to a pair of Queens. Alternatively, suppose the Queen of Clubs 1510 is held and the player finishes with a bottom hand of Queen of Clubs 1510 and a low pair. The Queen of Spades from the upper hand 1410 will substitute into the bottom hand 1400 to "raise" the poker rank of the bottom hand 1400 from a low pair to, depending upon the location of the low pair in the bottom hand 1400, a pair of Queens or two pair.

Figure 23:
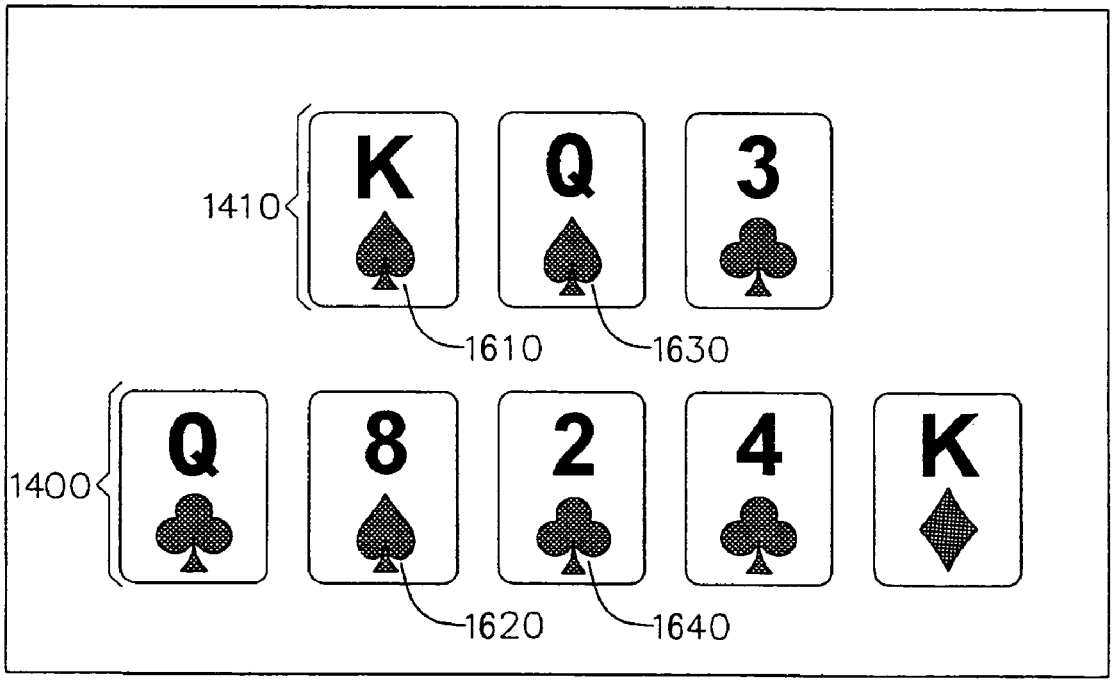
FIG. 23 shows a screen display according to the embodiment of FIG. 21 after the replacement cards were issued for the bottom row.

One possible draw after holding the Queen of Clubs 1510 is shown in FIG. 23. The player has drawn Eight of Spades, Deuce of Clubs, Four of Clubs, and King of Diamonds in the bottom hand 1400. As noted above, this optional embodiment utilizes a substitution rule in which any card may substitute if the poker ranking of the receiving hand is greater or equal after the substitution. Upon examination, the King of Spades 1610 from the upper hand 1410 can substitute for the Eight of Spades 1620 in the bottom hand 1400 to give a pair of Kings in the bottom hand 1400. Also, the Queen of Spades 1630 from the upper hand 1410 can substitute for the Deuce of Clubs 1640 in the bottom hand 1400 to give a pair of Queens in the bottom hand 1410.

Figure 24:
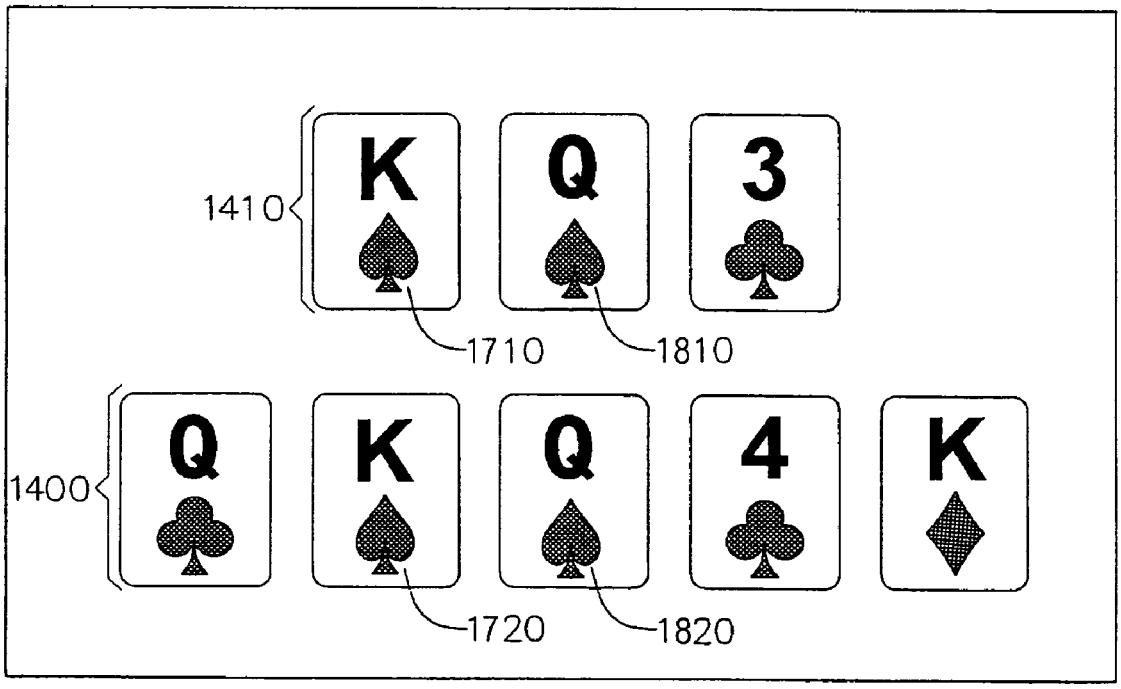
FIG. 24 shows a screen display according to the embodiment of FIG. 21 after the King of Spades and Queen of Spades have been replicated from an upper row to a bottom row.

As shown in FIG. 24, the consequence is that the King of Spades 1710 in the upper hand 1410 has been replicated and the replica King of Spades has been substituted into the bottom hand 1400 in the vertically aligned position 1.720 below. Similarly, the Queen of Spades 1810 from the upper hand 1410 has been replicated and the replica Queen of Spades has been substituted into the bottom hand 1400 in the vertically aligned position 1820 below. Awards, if any, will be determined by the bottom hand 1400 holding two pair, Kings and Queens, and the upper hand 1410 holding King high.

The lower hand 1400 may be awarded according to the paytables described above and shown in Tables 1, 2, or 3 or any other paytable. A paytable may also be constructed for the upper hand 1410. Since the upper hand 1410 in this optional embodiment includes fewer than five cards, certain hands, such as full house and four of a kind, would not be possible. However, a paytable issuing rewards for pair, three of a kind, flush, straight, straight flush, and/or other hands, may be constructed. With reference to FIG. 24, in an embodiment that rewards a pair or higher in the upper hand 1410, a holding of King of Spades, Queen of Spades, and Three of Clubs would not be rewarded. However, in an embodiment that rewards a pair of Jacks or better in the bottom hand 1400, a holding of two pair, Kings and Queens, would be rewarded.

While certain embodiments of the present invention have been shown and described it is to be understood that the present invention is subject to many modifications and changes without departing from the spirit and scope of the claims presented herein.

TABLE 1

| Poker Hand Ranking | Reward per Unit Wager |
|---|---|
| Royal Flush | 800 |
| Straight Flush | 250 |
| Five of a Kind (Aces) | 400 |
| Four of a Kind (Aces) | 80 |
| Four of a Kind (2 thru King) | 25 |
| Full House | 8 |
| Flush | 5 |
| Straight | 4 |
| Three of a Kind | 3 |
| Two Pair | 2 |
| Pair of Jacks or Better | 1 |

TABLE 2

| Poker Hand Ranking | Reward per Unit Wager |
|---|---|
| Royal Flush | 800 |
| Straight Flush | 250 |
| Five of a Kind (Aces) | 400 |
| Four of a Kind (Aces) | 80 |
| Four of a Kind (2 thru King) | 50 |
| Full House | 9 |
| Flush | 6 |
| Straight | 4 |
| Three of a Kind | 3 |
| Two Pair | 1 |
| Pair of Jacks or Better | 1 |

TABLE 3

| Poker Hand Ranking | Reward per Unit Wager |
|---|---|
| Royal Flush | 800 |
| Straight Flush | 250 |
| Five of a Kind (Aces) | 400 |
| Four of a Kind (Aces) | 50 |
| Four of a Kind (2 thru King) | 25 |
| Full House | 9 |
| Flush | 6 |
| Straight | 4 |
| Three of a Kind | 3 |
| Two Pair | 2 |
| Pair of Jacks or Better | 1 |

We claim:

1. A method of playing a card game, comprising:

designating at least one playing card to be a substitute card;

defining a substitution pattern for said substitute card;

dealing a first player hand of cards and at least one additional player hand of cards;

playing said first player hand to completion;

determining a poker rank of said completed first player hand;

for each substitute card in said additional player hands, replacing a card in another player hand with a replica of said substitute card according to said predefined substitution pattern; and rewarding said player hands according to the poker rank of each player hand after replacement, if any.

2. The method of claim 1 wherein replacement of a card in a player hand with a replica of said substitute card according to said substitution pattern occurs without regard to the effect of the replacement on the poker rank for the player hand receiving the substitute card.

3. The method of claim 1 wherein replacement of a card in a player hand with a replica of said substitute card according to said substitution pattern occurs only if the replacement results in an equal or improved poker rank for the player hand receiving the substitute card.

4. The method of claim 1 wherein the quantity of cards in at least one of said additional player hands is unequal to the quantity of cards in said first player hand.

5. A method of playing a card game, comprising:

designating at least one playing card to be a substitute card;

defining a substitution pattern for said substitute card;

dealing a first player hand of cards and at least a second player hand of cards and a third player hand of cards;

playing said first player hand to completion;

determining a poker rank of said completed first player hand;

for each substitute card of said third player hand, replacing a card in said first or second player hand with a replica of said substitute card according to said predefined substitution pattern;

for each card of said second player hand, replacing a card in said first or third player hand with a replica of said substitute card for a card according to said predefined substitution pattern; and rewarding said player hands according to the poker rank of each player hand after replacement, if any.

6. The method of claim 5 wherein replacement of a card in said first, second, and third player hand with a replica of said substitute card according to said substitution pattern occurs without regard to the effect of the replacement on the poker rank for the player hand receiving the substitute card.

7. The method of claim 5 wherein replacement of a card in said first, second, and third player hand with a replica of said substitute card according to said substitution pattern occurs only if the replacement results in an equal or improved poker rank for the player hand receiving the substitute card.

8. A method of playing a card game, comprising:

designating at least one playing card to be a substitute card;

defining a substitution pattern for said substitute card;

dealing a first player hand of cards and a second player hand of cards;

playing said first player hand to completion;

determining a poker rank of said completed first player hand;

for each card of said second player hand, replacing a card in said first player hand with a replica of said substitute card according to said predefined substitution pattern; and rewarding said first and second hands according to the poker rank of said first and second player hand after replacement, if any.

9. The method of claim 8 wherein replacement of a card in said first player hand with a replica of said substitute card according to said substitution pattern occurs without regard to the effect of the replacement on the poker rank for said first player hand.

10. The method of claim 8 wherein replacement of a card in said first player hand with a replica of said substitute card according to said substitution pattern occurs only if the replacement results in an equal or improved poker rank for the first player hand.

11. A method of playing a card game, comprising:

designating at least one playing card to be a substitute card;

defining a substitution pattern for said substitute card;

dealing a first player hand of cards and at least one additional player hand of cards;

selecting zero or more cards from said first player hand to hold;

discarding cards not held from said first player hand;

completing said first player hand by dealing additional cards to replace said discarded cards;

determining a poker rank of said completed first player hand;

examining each additional player hand in serial fashion and for each substitute card in said additional player hands including any substitute card replicas received from another player hand, replacing a card in another player hand with a replica of said substitute card according to said predefined substitution pattern; and rewarding each player hand individually according to the poker rank of each player hand after replacement, if any.

12. The method of claim 11 wherein replacement of a card in a player hand with a replica of said substitute card according to said substitution pattern occurs without regard to the effect of the replacement on the poker rank for the player hand receiving the substitute card.

13. The method of claim 11 wherein replacement of a card in a player hand with a replica of said substitute card according to said substitution pattern occurs only if the replacement results in an equal or improved poker rank for the player hand receiving the substitute card.

14. A method of playing a card game, comprising:

designating at least one playing card to be a substitute card;

defining a substitution pattern for said substitute card;

dealing a first player hand of cards and at least a second player hand of cards and a third player hand of cards;

selecting zero or more cards to hold;

discarding cards not held;

completing said first player hand by dealing additional cards to replace said discarded cards;

determining a poker rank of said completed first player hand;

for each substitute card of said third player hand, replacing a card in said second player hand with a replica of said substitute card for a card in said second player hand according to said predefined substitution pattern;

for each substitute card of said second player hand, including any substitute card replicas received from said third player hand, replacing a card in said first player hand with a replica of said substitute card according to said predefined substitution pattern; and rewarding each player hand individually according to the poker rank of each player hand after replacement, if any.

15. The method of claim 14 wherein replacement of a card in said first and second player hand with a replica of said substitute card according to said substitution pattern occurs without regard to the effect of the replacement on the poker rank for the player hand receiving the substitute card.

16. The method of claim 14 wherein replacement of a card in said first and second player hand with a replica of said substitute card according to said substitution pattern occurs only if the replacement results in an equal or improved poker rank for the player hand receiving the substitute card.

* * * * *